US006987942B2

(12) United States Patent
Yoshikawa et al.

(10) Patent No.: US 6,987,942 B2
(45) Date of Patent: Jan. 17, 2006

(54) TONER SUPPLY KIT

(75) Inventors: Junko Yoshikawa, Toride (JP); Yutaka Ban, Tokyo (JP); Tetsuo Isomura, Abiko (JP); Hironori Minagawa, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 10/419,758

(22) Filed: Apr. 22, 2003

(65) Prior Publication Data

US 2004/0033087 A1 Feb. 19, 2004

(30) Foreign Application Priority Data

Apr. 24, 2002 (JP) ..... 2002-122130
Mar. 6, 2003 (JP) ..... 2003-059491

(51) Int. Cl.
*G03G 15/08* (2006.01)

(52) U.S. Cl. ..... 399/258; 399/260; 399/262

(58) Field of Classification Search ..... 399/262, 399/258, 120, 119, 227, 260; 222/DIG. 1; 141/363, 364
See application file for complete search history.

(56) References Cited

U.S. PATENT DOCUMENTS

| | | | | |
|---|---|---|---|---|
| 5,565,973 A | | 10/1996 | Fujishiro et al. | 399/227 |
| 5,721,433 A | | 2/1998 | Kosaka | 250/573 |
| 5,752,141 A | | 5/1998 | Nishimura et al. | 399/227 |
| 5,768,662 A | * | 6/1998 | Sugihara et al. | 399/119 |
| 5,774,772 A | * | 6/1998 | Kai et al. | 399/260 |
| 5,870,652 A | | 2/1999 | Kanamori et al. | 399/106 |
| 5,890,040 A | | 3/1999 | Matsuoka et al. | 399/262 |
| 6,131,008 A | | 10/2000 | Kanamori et al. | 399/263 |
| 6,192,211 B1 | | 2/2001 | Kimura | 399/227 |
| 6,298,208 B1 | | 10/2001 | Kawamura et al. | 399/262 |
| 6,356,729 B1 | | 3/2002 | Sasaki et al. | 399/258 |
| 6,418,290 B1 | | 7/2002 | Isomura et al. | 399/254 |
| 6,470,163 B1 | | 10/2002 | Minagawa | 399/256 |
| 6,493,516 B2 | | 12/2002 | Murakami et al. | 399/9 |
| 2001/0044059 A1 | | 11/2001 | Miyamoto et al. | 430/45 |
| 2002/0071698 A1 | | 6/2002 | Isomura et al. | 399/263 |
| 2002/0106215 A1 | | 8/2002 | Ban et al. | 399/120 |
| 2002/0122676 A1 | | 9/2002 | Yamada et al. | 399/263 |
| 2002/0127029 A1 | | 9/2002 | Yamada et al. | 399/106 |

FOREIGN PATENT DOCUMENTS

| | | |
|---|---|---|
| JP | 57-111543 | 7/1982 |
| JP | 60-103356 | 6/1985 |
| JP | 2-135471 | 5/1990 |
| JP | 6-337586 | 12/1994 |
| JP | 7-44000 | 2/1995 |
| JP | 7-301947 | 11/1995 |
| JP | 8-1531 | 1/1996 |
| JP | 8-44183 | 2/1996 |
| JP | 8-136439 | 5/1996 |
| JP | 9-218575 | 8/1997 |
| JP | 10-254229 | 9/1998 |
| JP | 10-260574 | 9/1998 |
| JP | 2000-137351 | 5/2000 |
| JP | 2000-214669 | 8/2000 |
| JP | 2000-284588 | 10/2000 |
| JP | 2000-352840 | 12/2000 |

* cited by examiner

*Primary Examiner*—Sophia S. Chen
(74) *Attorney, Agent, or Firm*—Fitzpatrick, Cella, Harper & Scinto

(57) ABSTRACT

A toner supplying kit for being detachably set in an image forming apparatus to supply toner thereto, the toner supplying kit includes a toner container for containing toner; a discharge opening, provided in the toner container, for discharging the toner; plural feeding projections, projected inwardly in the toner container, for feeding the toner in the toner container toward the discharge opening with rotation of the toner container, wherein a uniaxial collapse stress of the toner when a vertical stress of 128 g/cm$^2$ is applied thereto is 2.0–8.0 g/cm$^2$.

10 Claims, 14 Drawing Sheets

TONER SUPPLY KIT

FIELD OF THE INVENTION AND RELATED ART

The present invention relates to a toner supply kit for supplying an image forming apparatus, for example, a copying machine, a printer, a facsimileing machine, etc., employing an electrophotographic or electrostatic recording method, with toner.

As the developer for an image forming apparatus such as an electrophotographic copying machine or an electrophotographic printer, developer in the state of fine powder has long been used. After the developer in the main assembly of an image forming apparatus is entirely consumed, the image forming apparatus is provided with a fresh supply of developer, with the use of a developer supply container.

Since developer is in the form of fine powder, there has been the problem that while an operator is supplying an image forming apparatus with a fresh supply of developer, the developer scatters, contaminating the image forming apparatus, and adjacencies thereof, as well as the operator. Thus, various methods for disposing a developer supply container with a small outlet, in the main assembly of an image forming apparatus, in such a manner that the developer is discharged as necessary, by a small amount, from the developer supply container through the small outlet thereof, has been proposed, and some of them have been put to practical use. In the case of these methods, it is rather difficult to automatically and reliably discharge the developer solely relying on the natural force, that is, the gravitational force. Therefore, some means for conveying the developer, while stirring it, is necessary.

There have been various widely known developer supply containers equipped with a stirring-conveying member, which is disposed within the container. In the case of these conventional developer supply containers, the torque necessary to drive the stirring-conveying member is substantial, although it varies depending on the component count and the amount of the developer in the container. Further, when the developer in the container is in a certain condition, the torque required to drive the stirring-conveying member is unexpectedly large. Recently, therefore, developer supply containers of a new type have become mainstream. These new developer supply containers are provided with a single or plurality of projections or ribs for conveying developer, which are integral parts of the containers. The developer is discharged as the developer supply containers are rotated. Some of these developer supply containers are directly rotated, and others are mounted in a rotary type developing apparatus so that they are orbitally moved as the rotary type developing apparatus is rotated.

For example, the developer supply container disclosed in Japanese Laid-open Patent Application 2,000-284588 is in the form of a hollow cylinder, and is mounted in a rotary type developing apparatus so that its axial line becomes horizontal. As the rotary type developing apparatus is rotated, the developer in the developer supply container is conveyed in the lengthwise direction of the container to be supplied to the developing device.

The developer supply containers disclosed in Japanese Laid-open Patent Applications 7-44000 and 10-260574 comprise: a cylindrical bottle; a single or plurality of spiral ribs placed on the internal surface of the bottle; a small developer outlet positioned roughly in the center of one of the end walls of the bottle; and a guiding portion placed on the internal surface of the bottle, next to the same end wall as the end wall-having the developer outlet. As the developer supply container itself is rotated, the developer therein is conveyed toward the outlet by the spiral ribs on the internal surface of the bottle, and then, is lifted to the outlet by the guiding portion placed next to the outlet, being thereby discharged from developer supply container.

Japanese Laid-open Patent Application 9-218575 discloses a developer supply container which is mounted into a rotary type developing apparatus. This developer supply container comprises a spiral agitator, which is disposed within the developer supply container. In the case of this developer supply container, the developer in the developer supply container is convened, while being stirred, to the developing device, by rotating the agitator independently from the rotation (orbital movement) of the developer supply container itself resulting from the rotational driving of the rotary type developing apparatus.

The developer supply containers disclosed in Japanese Laid-open Patent Applications 6-337586 and 2,000-214669 comprise: a cylindrical bottle; a single or plurality of spiral ribs placed on the internal surface of the bottle; and a small outlet placed in the cylindrical wall of the bottle. As the developer supply container itself is rotated, the developer therein is conveyed toward the outlet by the spiral ribs in the bottle, and then, is discharged from the developer supply container through the outlet in the cylindrical wall.

The developer supply container disclosed in Japanese Patent Application Publication 8-1531 is roughly in the form of a cylindrical bottle, which has a spiral continuous rib extending on the internal surface of the bottle. As the bottle itself is rotated, the toner therein is conveyed by the spiral rib in the bottle. This patent application publication also discloses a modification of the above developer supply container, in which instead of the above described continuous spiral rib, a plurality of discontinuous spiral ribs, or a plurality of spirally aligned pins or plates are disposed.

The developer supply container disclosed in Japanese Laid-open Patent Application 10-254229 comprises: a cylindrical bottle; a single or plurality of spiral ribs placed on the internal surface of the bottle; and a combination of a small developer outlet and a screw positioned at one end of the bottle. This developer supply container is mounted into a rotary type developing apparatus, in such a manner that it is prevented from rotating relative to the developing apparatus. Thus, as the rotary type developing apparatus is rotated, this developer supply container is moved in a manner to orbit about the rotational axis of the rotary type developing apparatus, and the developer therein is conveyed to the screw by the spiral ribs in the bottle, being thereby conveyed to the outlet by the screw to be eventually discharged from the developer supply container.

The developer supply containers disclosed in Japanese Laid-open Patent Application 8-44183 comprises: a plurality of developer guiding ribs disposed in parallel to the rotational direction of the developer supply container to conveyed the developer in the developer supply container to the developer outlet in the peripheral wall of the container proper. This developer supply container is mounted in a rotary type developing apparatus, in such a manner that it is not rotatable about its axial line. As the rotary type developing apparatus is rotated, the developer supply container is orbitally moved about the rotational axis of the rotary type developing apparatus. As a result, the developer in the developer supply container is conveyed toward the outlet by the internal ribs of the container proper, and then, is discharged from the developer supply container.

However, the above described developer supply containers in accordance with the prior arts suffer from the following problems.

The developer supply containers disclosed in Japanese Laid-open Patent Applications 7-44000, 10-260574, 6-337586, 2,000-214669, 10-254229, and 2,000-284588, which have a single or plurality of internal spiral ribs, do not have a single or plurality of active internal stirring members. Therefore, if the developer in any of these developer supply containers is agglomerated into developer particles of larger sizes by the vibrations during the shipment of the developer supply container, or agglomerates into developer particles of larger sizes while the developer supply container is left unattended for a long period time in a high temperature and high humidity environment, the developer particles of larger sizes are conveyed to the developer outlet without being un-agglomerated. As a result, the outlet is partially, or sometimes entirely blocked by the particles of the agglomerated developer, reducing the rate of the developer discharge from the developer supply container. This problem is particularly evident in the case of the developer supply containers, the outlet of which is in the cylindrical wall portion of the developer supply container. That is, in the case of any of these developer supply containers, it is assumed that as a developer supply container is moved in the orbital fashion, the developer therein is stirred due to the orbital movement of the developer supply container, being thereby fluidized and conveyed in the axial direction of the developer supply container. In other words, it is assumed that the developer is conveyed solely by being in the fluid state. None of these developer supply containers has a mechanism for aggressively conveying the developer therein in the axial direction of the developer supply container. Therefore, it suffers from the problem that a substantial amount of the developer therein is unusable; and it remains unused.

Further, the contour of the internal surface of any of the above described developer supply containers is simple; it is not shaped or structured to be effective to fluidize the developer in the developer supply container as the developer supply container is moved in the orbital fashion. Thus, if any of the above described developer supply containers is mounted into a rotary type developing apparatus, with the developer therein left in the agglomerated state resulting from the shipment or storage of the developer supply container, the developer therein sometimes is not discharged from the developer supply container for a while after the developer supply container begins to be moved in the orbital fashion. In this situation, the no developer warning is not cancelled in spite of the mounting of a replacement developer supply container, making it necessary for an operator to remove the replacement developer supply container from the rotary type developing apparatus, shake it, and remount it.

In comparison, the developer supply container disclosed in Japanese Laid-open Patent Application 9-218575 comprises a spiral agitator, which is driven independently from the cylindrical bottle, while the cylindrical bottle is rotated in the orbital fashion by the rotary type developing apparatus. Thus, it is assured that the developer in this developer supply container is conveyed in the axial direction of the cylindrical bottle. However, this developer supply container requires bearings for the agitator, sealing mechanism for sealing the bearings, etc., in addition to the agitator. In other words, it is larger in component count, having therefore the problem of higher manufacturing cost. Also in the case of this developer supply container, the main assembly of an image forming apparatus requires a motor, a gear train, a clutch, etc., for rotationally driving the agitator in the developer supply container, in addition to those for rotating the rotary type developing apparatus, increasing therefore the manufacturing cost of the apparatus main assembly. Further, the agitator rubs against the internal wall of the cylindrical bottle, presenting a possibility that the developer will be dragged into the nip between the agitator and internal wall of the cylindrical bottle, and will be agglomerated and/or melted, in the nip, into developer particles of larger diameters, that is, approximately several tens of micrometers, which adversely affects image formation.

Moreover, the developer supply containers having the internal spiral ribs suffer from problems related to their manufacture. That is, when molding them using an injection molding method, some portions of the spiral ribs constitute the so-called undercut portions (undercut means protrusive or recessive portion of metallic mold or molded product itself, which interferes with removal of molded product from mold), making it necessary to fill the undercut portions,with resin; in other words, resin is wasted. As a result, not only is the cost of the developer supply container material increased, but also the internal volume of the developer supply container is reduced.

Further, if a blow molding method, or a stretch blow molding method is used to mold the developer supply containers, the choices of the resinous material for the developer supply container are limited to those compatible with the blow molding method or stretch blow molding method, for example, PET (polyethylene-terephthalate), PVC (polyvinyl chloride), HDPE (high density polyethylene), LDPE (low density polyethylene), and PP (polypropylene). When it comes to the matter of incombustibility or flame resistance, the material selection is particularly difficult. That is, there are no flame resistant versions of HDPE, LDPE, and PP on the market. PVC is flame resistant, but it is not usable because of its environmental impact. There are flame resistant versions of PE, but the usage of this material limits the selection of a molding method to injection blow molding methods. The molds for an injection blow molding method are expensive. Therefore, the usage of an injection blow molding method makes the unit cost of a developer supply container rather high, since each type of developer supply container is not manufactured by a number large enough to offset the high cost of the molds.

In the case of the structure disclosed in Japanese Patent Application Publication 8-1531, a plurality of ribs are spirally aligned with the provision of intervals. Therefore, while the developer is conveyed, a certain portion of the developer falls through the intervals, failing to be further conveyed by the adjacent rib. In other words, this structure is inferior in terms of developer conveyance efficiency.

The developer supply containers disclosed in Japanese Laid-open-Patent Application 10-254229 comprises the screw for discharging the developer, which is located at one end of the container. Thus, its component count is greater, and therefore, its cost is higher.

The developer supply container structure disclosed in Japanese Laid-open Patent Application 8-44183 is rather difficult to apply to those developer supply containers which are relatively long in terms of axial direction; its application to such a developer supply container reduces the angle of the ribs, which results in the reduction of the developer conveyance efficiency.

Also in the case of the structure disclosed in Japanese Laid-open Patent Application 8-44183, there is little chance that the portions of the developer in the developer supply container, which were agglomerated or compacted by the vibrations during the shipment of the developer supply container, and/or became agglomerated or compacted while the developer supply container was left unattended for a long time in a high-temperature and high-humidity environment, or due to the like situation, will be loosened or fluffed. Therefore, the agglomerated or compacted portions of the developer negatively affect image formation. This problem is particularly evident when a highly adhesive developer or a developer prone to agglomeration is used. In other words, presently, this structure limits the choice of the developer supplied to the developing device with the use of a developer supply container.

Further, it has been thought that in the case of a developer supply container structure, such as the above described one, which does not comprise an active stirring member, the values of the physical properties, such as fluidity index or degree of agglomeration, of developer has a significant effect on the efficiency with which the developer is conveyed.

There have been made several inventions regarding a developer supply container, in which the above described structure was combined with several developers different in physical properties. Japanese Laid-open Patent Application 2,000-352840, that is, one of such inventions, proposes the idea of matching a developer and a developer supply container structured as described above, based on the particle size distribution of the developer. Further, Japanese Laid-open Patent Application 2,000-137351 proposes to match a developer and a rotational developer supply container having no agitator, based on the circularity of the developer.

However, these developer supply containers have a peculiar problem related to their structures, that is, the problem related to the efficiency with which the portions of the developer in the developer supply container, which were agglomerated or compacted by the vibrations during the shipment of the developer supply container, and/or became agglomerated or compacted while the developer supply container was stored unattended for a long time in a high-temperature and high-humidity environment, or due to the like situation, as described above, are discharged from the developer supply container. Thus, the developer properties to be concerned with are the properties of developer in the somewhat compacted stated. In other words, developer cannot be expected to be efficiently discharged by matching a developer with a developer container structured as described above, simply based on the aforementioned physical properties (average particle diameter, circularity, etc.), that is, without taking into consideration the state of the developer in a given environment.

SUMMARY OF THE INVENTION

The primary object of the present invention is to provide a toner supply kit capable of efficiently conveying the toner therein, and discharging the toner therefrom, as soon as it begins to be driven.

Another object of the present invention is to provide a toner supply kit capable of maintaining at a desired level the amount by which toner is discharged therefrom, from the moment it begins to be driven until its driving is stopped.

Another object of the present invention is to provide a toner supply kit, which is much smaller in the unusable amount of the toner therein than a toner supply kit in accordance with the prior arts.

Another object of the present invention is to provide a toner supply kit capable of preventing its toner outlet from being blocked by the toner therein regardless of its past or present environment.

Another object of the present invention is to provide a toner supply kit superior in toner stirring performance to a toner supply kit in accordance with the prior arts.

Another object of the present invention is to provide a toner supply kit superior in toner stirring performance and toner conveyance efficiency to a toner supply kit in accordance with the prior arts.

Another object of the present invention is to provide a toner supply kit lower in manufacture cost to a toner supply kit in accordance with the prior arts.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. However, the measurements, materials, and shapes of the structural components in the following embodiments, and their relative positions should be optimally altered depending on the structures of the apparatuses to which the present invention is applied, and the various conditions related thereto. In other words, unless specifically stated, the following embodiments of the present invention are not intended to limit the scope of the present invention.

Figure 1:
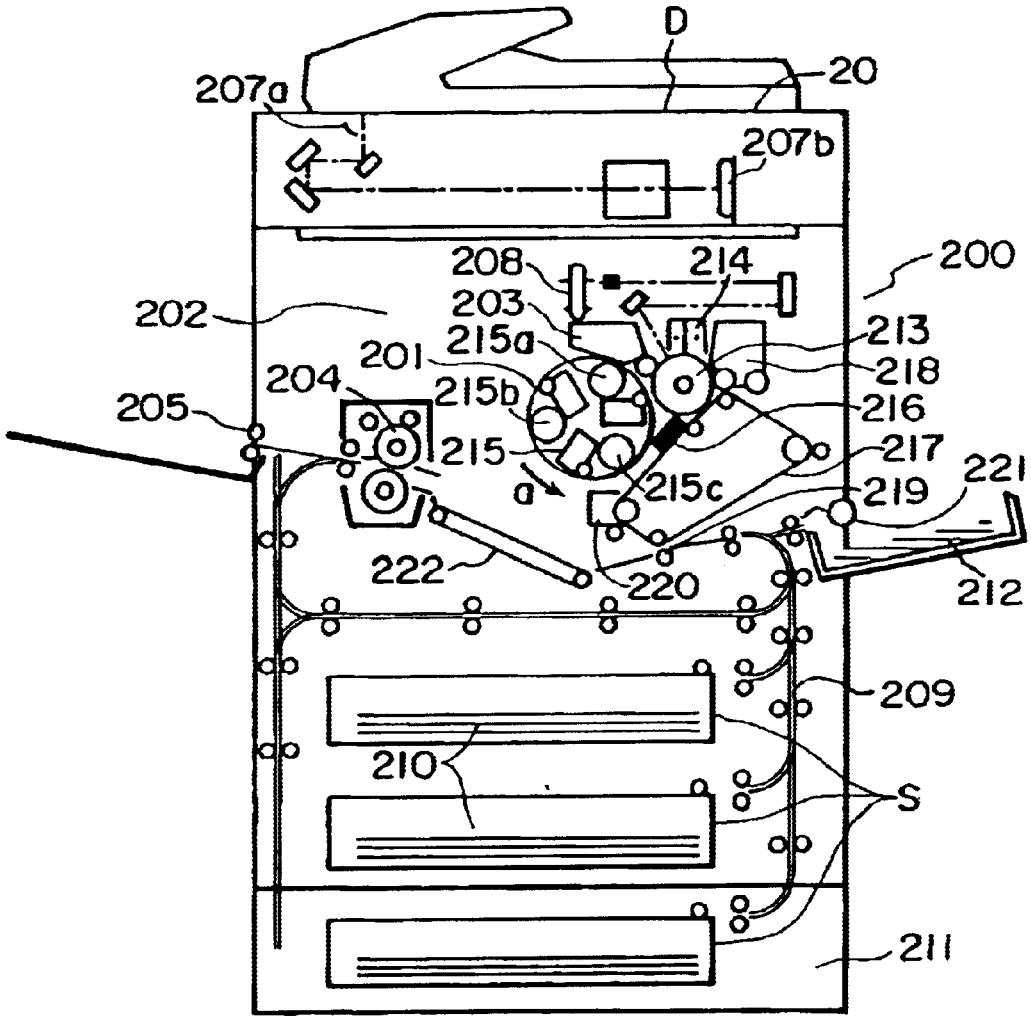
FIG. 1 is a sectional view of an image forming apparatus comprising a rotary type developing apparatus in which a single or plurality of developer supply containers are mounted.

First, referring to FIG. 1, the structure of the electrophotographic image forming apparatus, in which a single or plurality of developer supply containers in this embodiment of the present invention are mountable, will be described. FIG. 1 shows an example of a multicolor image forming apparatus (color copier) comprising a rotary type developing apparatus.

The image forming apparatus in FIG. 1 is a multicolor image forming apparatus comprising a rotary type developing apparatus 201 which best displays the characteristics of a rotary type developing apparatus.

The main assembly 200 of the image forming apparatus comprises an original placement platen 206, a light source 207*a*, a CCD unit 207*b*, a laser scanner unit 208, a conveyance portion 209, an image forming portion 202, etc. The conveyance portion 209 has cassettes 210 and 211, and a manual feeder tray 212. The cassettes 210 and 211 are removably mountable in the main assembly 200 of the image forming apparatus, and store plurality of sheets of transfer medium S. From these cassettes 210 and 211 and manual feeder tray 212, a single or plurality of transfer mediums S are fed into the apparatus main assembly 200.

The image forming portion 202 comprises: a black image developing device 203 disposed separately from color image developing devices; a cylindrical photoconductive drum 213; a primary charging device 214; a rotary 201 internally holding a plurality of developing devices 215, each of which is integrally holding a developer supply container (toner cartridge); a post-charging device 216 for adjusting the image quality after the developing process; an endless transfer belt 217, onto which four toner images different in color are transferred in layers, and then, from which the multicolor image consisting of the transferred four toner images different in color is transferred onto a sheet of transfer medium; a drum cleaner 218 for cleaning the toner particles remaining on the peripheral surface of the photoconductive drum; a secondary transfer roller 219 for transferring the multicolor image from the transfer belt 217 onto a sheet of transfer medium; a belt cleaner 220 for removing the toner particles remaining on the transfer belt 217; etc.

On the upstream side of the image forming portion 202, a registration roller 221 is disposed, which precisely positions the transfer medium and releases it into the apparatus main assembly 200 in synchronism with the transfer of the multicolor image onto the transfer belt 217. On the downstream side, a transfer medium conveying apparatus 222, a fixing apparatus 204, a pair of discharge roller 205, etc., are disposed. The transfer medium conveying apparatus 222 is for conveying the transfer medium S after the transfer of the multicolor image, onto the transfer medium S, and the fixing apparatus is for fixing the unfixed image on the transfer medium S. The pair of discharge rollers 205 are for discharging the transfer medium S out of the image forming apparatus main assembly 200 after the fixation of the multicolor image.

Next, the operation of the image forming apparatus will be described.

As a sheet feeding signal is outputted from an unshown controlling apparatus provided on the apparatus main assembly 200 side, the transfer medium S is fed into the apparatus main assembly 200 from the cassette 210, cassette 211, or manual feeder tray 212. Meanwhile, an original D on the original placement platen 206 is illuminated by the light from a light source 207*a,* and the light reflected by the original is read, that is, converted into electrical signals, by a CCD unit 207*b*. Then, the electrical signals are sent to the laser scanner unit 208. The laser scanner unit 208 projects a beam of laser light while modulating it with the electrical signals from the CCD unit 207*b*, onto the photoconductive drum 213, the peripheral surface of which has just been charged by the primary charging device 214. As the charged peripheral surface of the photoconductive drum 213 is exposed to the beam of laser light from the laser scanner unit 208, an electrostatic latent image is formed on the peripheral surface of the photoconductive drum 213. Then, the electrostatic latent image is developed by the black color developing device 203, or one of the plurality of color developing devices 215 held by the rotary type developing apparatus 201. As a result, an image is formed of the black toner particles, or the color toner particles from one of color developing devices 215.

The toner image formed on the photoconductive drum 213 is adjusted in potential level by the post-charging device 216, and then, is transferred onto the transfer belt 217, at the transfer location. When the image forming apparatus is in the color mode, the transferred toner image on the transfer belt 217 remains on the transfer belt 217 during the first rotation of the transfer belt 217 after the transfer of the toner image onto the transfer belt 217, so that the next toner image can be transferred onto the toner image on the transfer belt 217. During this rotation of the transfer belt 217, the rotary type developing apparatus 201 is rotated in the direction indicated by an arrow mark a in order to position the next designated color developing device so that the color developing device opposes the photoconductive drum 213; it is prepared for developing the next electrostatic latent image. This sequence comprising the electrostatic latent image formation process, electrostatic latent image development process; and toner image transfer process, is repeated until all of the predetermined number of monochromatic toner images, different in color, for forming a full-color image are transferred in layers onto the transfer belt 217.

After being fed into the apparatus main assembly 200 by the conveyance portion 209, the transfer medium S is straightened in its positioning by the registration roller 221, and then, is released to be sent to the image forming portion 202 in synchronism with the formation of an image therein. After the transfer of the toner image by the secondary transfer roller 219, the transfer medium S is separated from the transfer belt 217, and is conveyed by the post-transfer conveying apparatus 222 to the fixing apparatus 204, in which the transferred but unfixed image is permanently fixed by heat and pressure. Thereafter, the transfer medium S now bearing the fixed image is discharged from the apparatus main assembly 200 by the pair of discharge rollers 205.

As described above, the transfer medium S fed into the apparatus main assembly 200 by the conveyance portion 209 is discharged from the apparatus main assembly 200 after the formation of an image thereon.

Referring to FIG. 1, the rotary type developing apparatus 201 holds three developing devices 215, that is, a yellow (Y) developing device 215*a*, a magenta (M) developing device 215*b*, and a cyan (C) developing device 215*c*, and is structured so that the development processes are carried out in the order in which the developing devices 215 are listed above. The rotational direction of the rotary type developing apparatus 201 in this embodiment is counterclockwise, as seen from the front side of the apparatus main assembly 200. However, the rotational direction of a rotary type developing apparatus 201 should be decided in consideration of the relationship between the developing devices 215 and photoconductive drum 213, the conditions under which the development processes are carried out, etc. Evidently, this embodiment is not intended to limit the rotational direction of a rotary type developing apparatus.

Three removably mountable developer supply containers 1 (FIG. 2), which will be described later, are removably mounted into the developing devices 215, that is, the developing devices 215*a*, 215*b*, and 215*c*, respectively, in such a manner that they do not rotate about their axial lines, and then, are mounted, as a part of the corresponding developing device, into the rotary type developing apparatus 201. During an image forming operation, they are moved in the orbital fashion about the axial line of the rotary type developing apparatus 201, by the rotation of the rotary type developing apparatus 201. If necessary, for example, after toner depletion, each developer supply container 1 can be easily replaced while the rotary type developing apparatus 201 is not in operation.

The rotary type developing apparatus 201 is structured so that as the developing devices 215*a*, 215*b*, and 215*c* are moved in the orbital fashion about the rotational axis of the rotary type developing apparatus 201, the toner in the toner supply containers 1 are always conveyed toward the toner outlet. With the provision of this structural arrangement, as the rotary type developing apparatus 201 is rotated, the developer in each developer supply container 1 is constantly supplied to the developer inlet of the corresponding unshown developing device 215. The developer inlet of the developing device 215 is structured so that not only does it receive and store the developer discharged from the developer supply container 1 by the orbital movement of the developer supply container 1 caused by the rotation of the rotary type developing apparatus 201, but also, it supplies the developer to the developing device 215 by a predetermined amount in response to the demand from the developing device 215. Each developing device 215 has a pair of developer conveying members 9*a*, which are disposed in the developing device and are opposite in the direction in which they convey the developer. Thus, as the pair of developer conveying members 9*a* are driven, the toner particles and carrier particles are circulated in the developing device while being uniformly mixed. Each developing device 215 also has a development sleeve 9*b*, which internally holds a magnet and is rotationally supported by its shaft. In operation, a magnetic brush is formed by attracting the mixture of the toner particles and carrier particles to the peripheral surface of the development sleeve 9*b*, and the toner particles adhering to magnetic particles are supplied to the photoconductive drum.

(Developer Supply Container in Embodiment 1)

Figure 2:
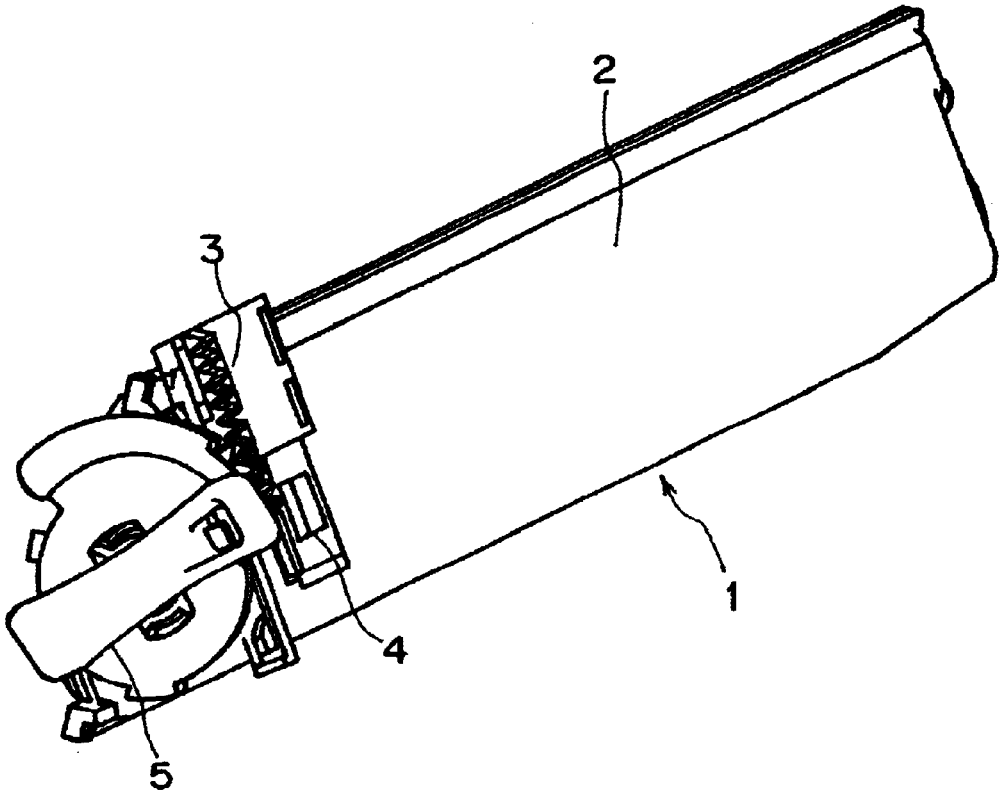
FIG. 2 is a perspective view of the developer supply container in the first embodiment of the present invention.
Figure 3:
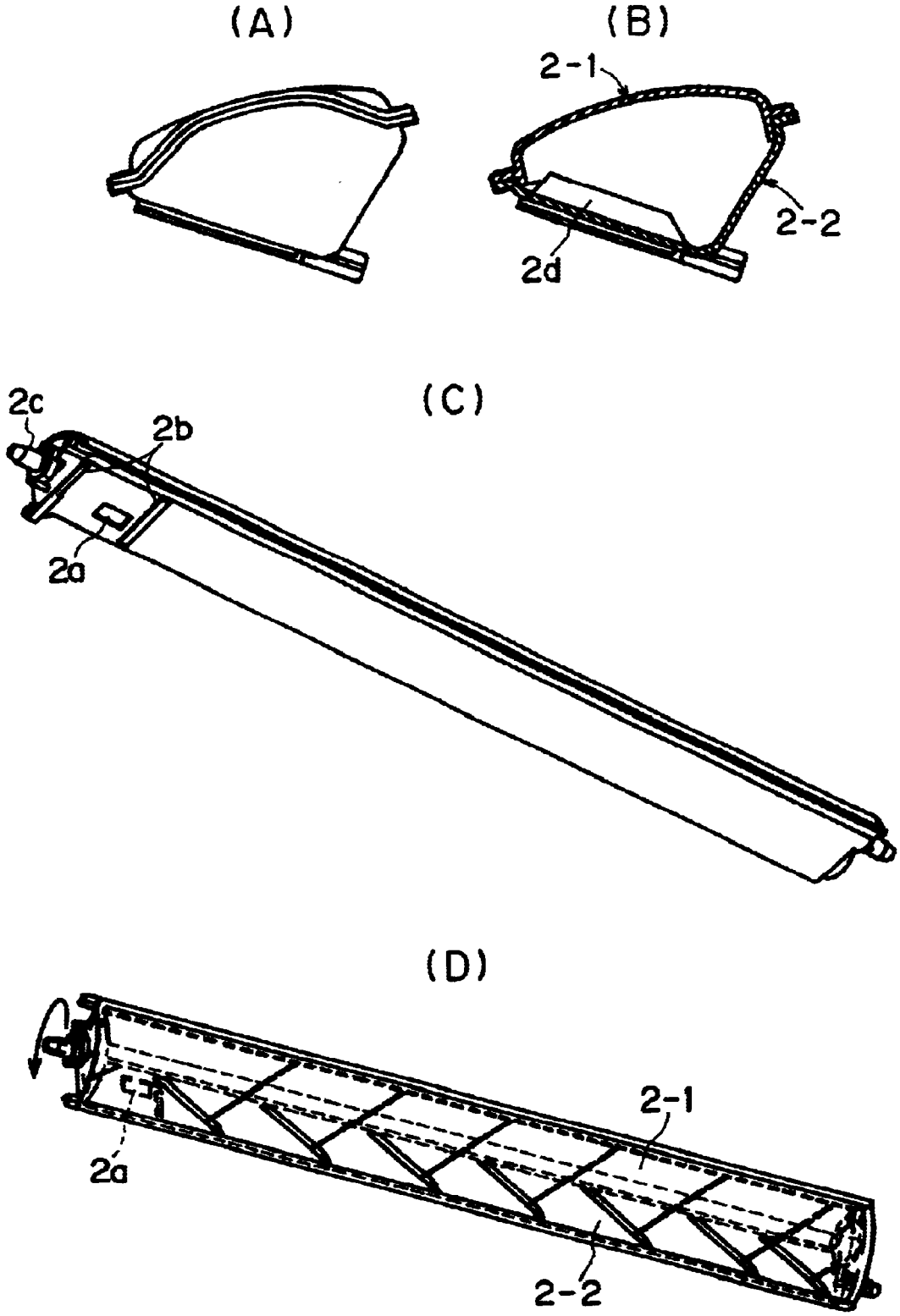
FIGS. 3(A), 3(B), 3(C), and 3(D) are front view, sectional view parallel to the end panels thereof, perspective view, and perspective phantom view, of the main assembly of the developer supply container, respectively.

Referring to FIG. 2, designated by a referential numeral 1 is the cylindrical hollow developer supply container in the first embodiment of the present invention. The developer supply container 1 in this embodiment comprises a main assembly 2 (container proper), a shutter 3, a sealing member 4, and a knob 5.

(Container Proper)

Referring to FIGS. 3(A) through 3(D), the structure of the main assembly 2 of the developer supply container 1 will be described. FIGS. 3(A), 3(B), 3(C), and 3(D) are a front view, sectional view parallel with the end panels thereof, perspective view, and perspective phantom view, of the main assembly of the developer supply container, respectively.

The container main assembly 2 has a developer outlet 2*a*, a shutter guide 2*b*, a knob guide 2*c*, and a plurality of particle conveyance ribs 2*d*.

As for the shape of the container main assembly 2 in terms of the sectional view, it does not matter as long as it enables the container main assembly 2 to store developer as much as possible while efficiently using the limited internal space of the rotary type developing apparatus. In this embodiment, the container main assembly 2 is in the form of a hollow tube, the contour of the sectional view of which perpendicular to the lengthwise direction of the container main assembly 2, is not circular. Concretely speaking, it is roughly in the form of a triangular pillar as shown in the drawing. Also in this embodiment, each developer supply container 1 to be mounted into the rotary type developing apparatus is cylindrical, and its full length is roughly the same as the length of the image formation range, which is approximately 380 mm.

Giving the container main assembly 2 the above described shape, that is, such a shape that its cross sectional shape perpendicular to the lengthwise direction of the main assembly 2 becomes a shape other than a circular shape, makes it possible to best utilize the limited internal space of the rotary type developing apparatus into which the developer supply container 1 is mounted. In other words, it can increase the amount of the developer which can be filled into each developer supply container, while leaving the shape of the rotary type developing apparatus as it is.

Figure 4:
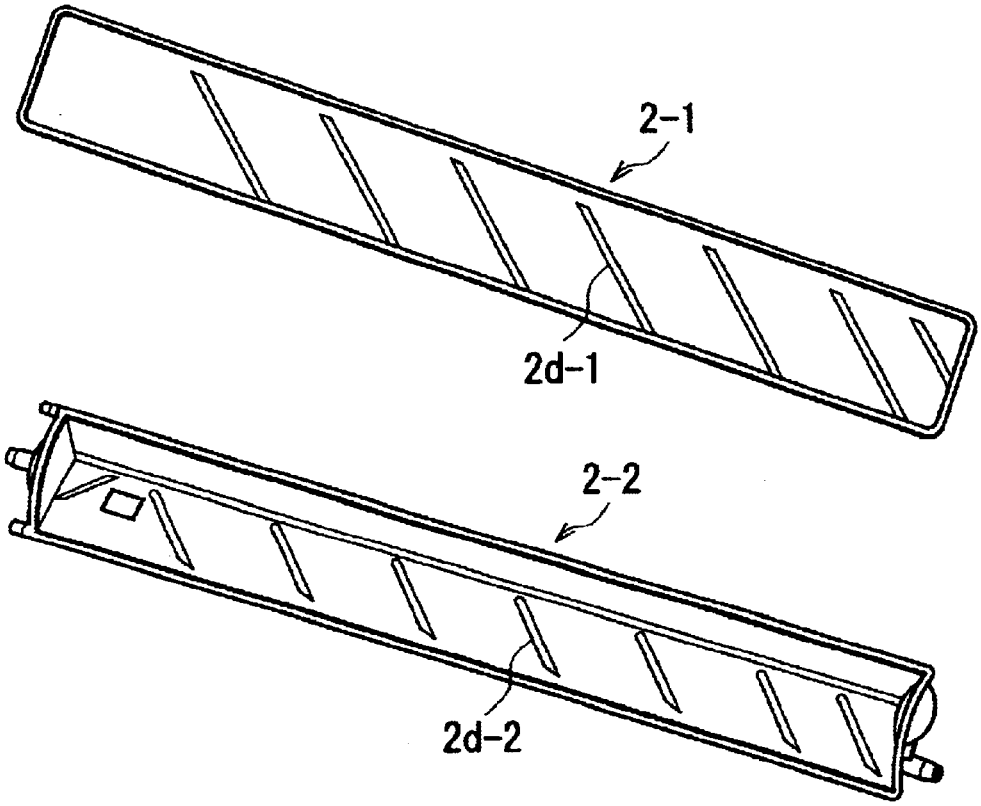
FIG. 4 is a drawing for describing the top and bottom members of the developer supply container in the first embodiment, as seen from the direction in which metallic molds are removed.

The container main assembly 2 in this embodiment comprising the top and bottom halves 2-1 and 2-2 is manufactured using the following method. First, the top and bottom halves 2-1 and 2-2 are separately molded, and then, are welded to each other by an ultrasonic welding method (FIGS. 4 and 5).

(Particle Conveyance Ribs)

The container main assembly 2 has a plurality of particle conveyance ribs 2*d* for conveying the developer in the container main assembly 2 toward the developer outlet 2*a*, which are erected in parallel on the internal surface of the flat walls of the container main assembly 2. More specifically, the top and bottom members 2-1 and 2-2 of the container main assembly 2 are provided with a set of flat ribs 2*d*-1 and a set of flat ribs 2*d*-2, respectively, as the particle conveyance means. In this embodiment, the heights of the conveyance ribs 2*d*-1 and 2*d*-2 are both 5 mm.

Figure 5:
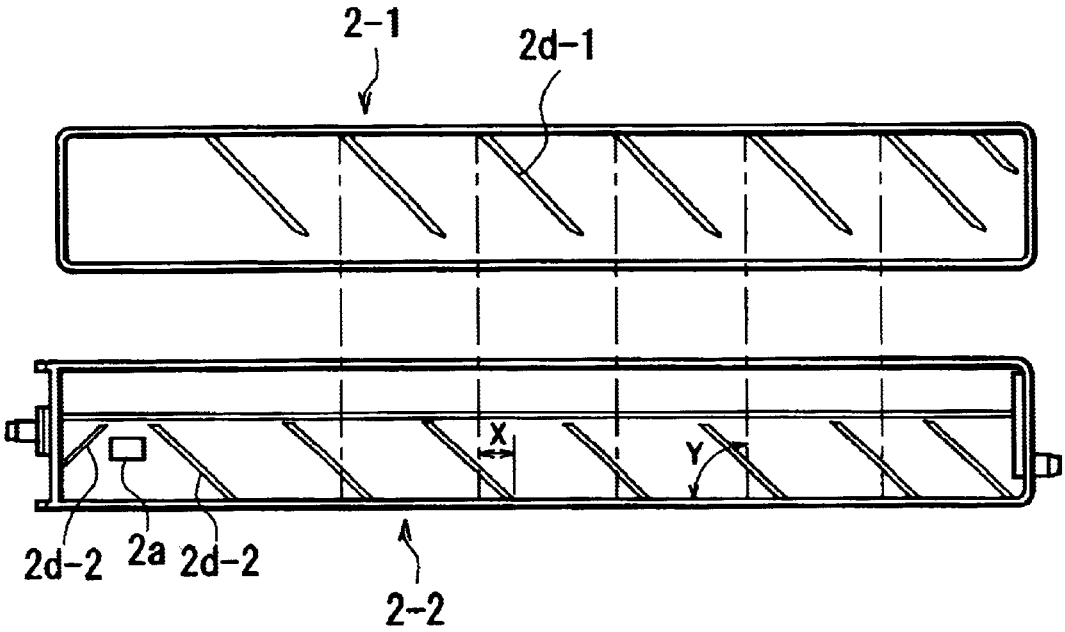
FIG. 5 is a drawing for describing the structures of the top and bottom members of the main assembly of the developer supply container in the first embodiment of the present invention.

Referring to FIG. 5, the angle Y of the particle conveyance ribs 2*d*-2 relative to the rotational axis of the rotary type developing apparatus is desired to be in a range of 20°–70°, preferably, in a range of 40°–50°. In this embodiment, it is 45°.

If the angle Y of the conveyance ribs 2*d* is no more than 20°, it is difficult for the developer particles to slide down on the conveyance ribs 2*d*, whereas if it is no less than 70°, it is necessary to increase the number of the conveyance ribs 2*d*, reducing thereby the internal space of the container main assembly 2.

Therefore, the angle Y of the conveyances rib 2*d* is made to be within the aforementioned range, so that the developer is conveyed at a preferable rate.

As described above, each of the set of particle conveyance ribs 2*d*-1 and set of particle conveyance ribs 2*d*-2 in the top and bottom members 2-1 and 2-2, respectively, of the container main assembly 2 is in the form of a piece of flat plate. Referring to FIG. 4, giving each particle conveyance rib 2*d* this flat shape makes it possible to mold the top and bottom members 2-1 and 2-2 of the container main assembly 2, which do not have any undercut, as seen from the direction in which the metallic molds are removed during the manufacture of the top and bottom members 2-1 and 2-2 (shape which appears like a straight line, as seen the from mold removal direction). In other words, giving each particle conveyance rib 2*d* the flat shape so that the conveyance rib 2*d* looks like a straight line, as seen from the mold removal direction, makes it possible to simplify the mold structure, to make it easier to manufacture the container main assembly 2, to reduce, by an amount as small as possible, the internal space of the container main assembly 2, in which developer is storable, and to reduce the cost of the container main assembly 2.

Referring to FIG. 5, the positional relationship between the set of conveyance ribs 2*d*-1 in the top member 2-1 of the container main assembly 2, and the set of conveyance ribs 2*d*-2 in the bottom member 2-2 of the container main assembly 2, is as shown in the drawing. In other words, in terms of the axial direction of the rotary type developing apparatus, the conveyance ribs 2*d*-1 in the top member 2-1 of the container main assembly 2 and the conveyance ribs 2*d*-2 in the bottom member 2-2 of the container main assembly 2 are alternately positioned, whereas in terms of the direction perpendicular to the axial direction of the rotary type developing apparatus, the conveyance rib 2*d*-1 and conveyance rib 2*d*-2 partially overlap by their lengthwise end portions. The amount (overlap amount) X, which here is measured as the length of the projection of any of the overlapping portions of the conveyance rib 2*d*-1 and conveyance rib 2*d*-2, is roughly 5 mm. Therefore, it is assured that after being conveyed a certain distance by the conveyance ribs 2*d*-1 of the top member 2-1, the developer particles are further conveyed by the conveyance ribs 2*d*-2 of the bottom member 2-2, and then, after being conveyed a certain distance by the conveyance ribs 2*d*-2 of the bottom member 2-2, they are further conveyed by the conveyance ribs 2*d*-1 of the top member 2-1. In other words, the developer particles are conveyed toward the developer outlet through the alternate repetition of the above described conveyance processes, being thereby efficiently conveyed. That is, allowing some of the developer particles to pass between the adjacent two ribs prevents the developer conveyance efficiency from deteriorating. Further, there is another benefit that the overlapping portions (overlapping end portions of each rib) contribute to the fluidization of the developer.

In other words, there are various directions in which the developer particles might be conveyed by these conveyance ribs 2*d*. Therefore, as the developer supply container is moved in the orbital fashion, the conveyance force which the developer particles in the developer supply container receive from the conveyance ribs changes. Thus, the body (layer) of the developer in the developer supply container is repeatedly subjected to a combination of a compression process (by gently angled surfaces) and a expansion process (by sharply angled surfaces). That is, each time a given portion of the body of the developer encounters one of the conveyance ribs, the body of the developer is fluffed up with air; in other words, it is fluidized. Therefore, by the time a given portion of the body of the developer arrives at the developer outlet to be discharged, it will have been well fluidized.

Further, as the developer supply container is orbitally moved by the rotation of the rotary type developing apparatus, the distance between the aforementioned two sets of conveyance ribs, that is, the set of conveyance ribs 2*d*-1 in the top member of the container main assembly and the set of conveyance ribs 2*d*-2 in the bottom member of the container main assembly, repeatedly turns vertical, causing the given portion of the body of the developer to fall through the air. As a result, the given portion of the developer is fluffed up by the air; it is fluidized. Thus, the given portion of the developer does not block the developer outlet, being therefore smoothly discharged therefrom; it is discharged at a higher speed.

Further, referring to FIG. 5, regarding the bottom member 2-2 of the container main assembly, the first and second conveyance ribs 2*d*-2, counting from one end of the bottom member 2-2 of the container main assembly, where the developer outlet 2*a* is located, are disposed in a manner to sandwich the developer outlet 2*a*, and the first conveyance rib 2*d*-2 is tilted in the direction opposite to those of the rest of the conveyance ribs 2*d*-2. Therefore, after being conveyed to the adjacencies of the developer outlet 2*a*, some of the developer particles in a given portion of the body of developer in the container main assembly are immediately discharged from the developer outlet 2*a* as the developer supply container is orbitally moved. The remaining portion of the given portion of the body of the developer remains in the range in which the developer outlet 2*a* is, and is further stirred, remaining thereby in the fluidized state, by these two conveyance ribs 2*d*-2, as the developer supply container is orbitally moved by the following rotation of the rotary type developing apparatus. Therefore, the blockage does not occur at the developer outlet 2*a*; the developer is smoothly discharged from the developer outlet 2*a*. Moreover, after being discharged into the developing device, the developer easily mixes with the developer pre-existing in the developing device. In particular, if the developer is of a two-component type, it is uniformly charged, virtually instantly.

As described above, in this embodiment, after being conveyed to the adjacencies of the developer outlet by the conveyance ribs, all of the given portions of the body of developer are not immediately discharged from the developer outlet. Instead, it is made to detour by the redirecting rib, before it is discharged. Therefore, the developer outlet is prevented from being blocked by the portion of the body of developer having arrived at the developer outlet. The redirected portion of the body of developer is further stirred before it is guided toward the developer outlet. Thus, it will be smoothly discharged as it is guided to the developer outlet.

(Manufacturing Method for Container Main Assembly)

A developer supply container can be manufactured by welding or gluing two or more parts formed by an injection molding method, an extrusion molding method, a blow molding method, etc. In this embodiment, the top and bottom members 2-1 and 2-2, shown in FIG. 4, are separately molded by an injection molding method, and are welded into the developer supply container main assembly 2, with the use of an ultrasonic welding machine. Although, in this embodiment, shock resistant polystyrene was used as the material for the developer supply container 1, other substances may be used.

The usage of a blow molding method or a stretch blow molding method limits the choice of the material for a developer supply container to such resins as PET (polyethylene-terephthalate), PVC (polyvinyl chloride), HDPE (high density polyethylene), LDPE (low density polyethylene), and PP (polypropylene), which are compatible with these two molding methods. When it comes to the matter of incombustibility or flame resistance, the material selection is particularly difficult. That is, there are no flame resistant versions of HDPE, LDPE, and PP on the market. PVC is flame resistant, but it is not usable because of its environmental impact. There are flame resistant versions of PET, but the usage of this material limits the selection of a molding method to injection blow molding methods. The molds for an injection blow molding method are expensive. Therefore, in the case of such a component as a developer supply container which is not manufactured by a number large enough to offset the high cost of the molds, the usage of an injection blow molding method makes the unit cost of the component rather high. In other words, PET is not a preferable material for a developer supply container.

As described above, using an injection molding method to manufacture a developer supply container (top and bottom members of container main assembly) does not limit the material choice for the developer supply container; it allows the usage of a flame resistant resin, making it easier to deal with safety and environmental concerns.

(Shutter)

Referring to FIG. 2, the shutter 3 is in the form of a piece of flat plate, the two opposing edges of which are bent in the form of a letter U, constituting guiding portions, whereas the container main assembly 2 is provided with a pair of parallel shutter guides 2*b*, which extend on the external surface of the container main assembly 2, in the direction perpendicular to the lengthwise direction of the container main assembly 2, in a manner to sandwich the developer outlet. The shutter 3 is attached to the container main assembly 2 by moving the shutter 3 so that the pair of parallel shutter guides 2*b* slide into the U-shaped grooves of the shutter 3, one for one, allowing the shutter 3 to be moved in the direction perpendicular to the lengthwise direction of the container main assembly 2.

Between the shutter 3 and container main assembly 2, a sealing member 4 is disposed, hermetically sealing the developer outlet 2*a* by remaining compressed by the shutter 3.

(Manufacturing Method for Shutter)

The shutter 3 is desired to be formed of plastic with the use of an injection molding method. However, other materials and other methods may be used. As the material for the shutter 3, a substance, the rigidity of which is greater than a certain level, is preferable. In this embodiment, it is manufactured using the combination of highly slippery ABS resin and an ejection molding method.

(Sealing Member)

Referring to FIG. 2, the sealing member 4 is disposed in a manner to surround the developer outlet 2*a* of the container main assembly 2, and seals the developer outlet by being compressed against the container main assembly 2 by the shutter 3. As the material for the sealing member 4, one of various well-known foamed substances or elastic substances can be used. In this embodiment, foamed polyurethane is used.

(Knob)

Also referring to FIG. 2, a knob 5 comprises a knob proper portion and a double-walled cylindrical portion. A part of the external surface of the external wall of the double-walled cylindrical portion is shaped in the form of a gear, and a part of the internal surface of the internal wall of the double-walled cylindrical portion is provided with a claw, which engages with a cylindrical projection (rib) on the end portion of the container main assembly 2. This claw is used to attach the knob 5 to the front end portion of the container main assembly 2 so that the knob proper portion can be rotated about the axial line of the double-walled cylindrical portion, along with the cylindrical portion. In this embodiment, the knob 5 is also manufactured with the use of the combination of shock resistant polystyrene and an injection molding method.

(Embodiment 2)

According to the present invention, the embodiment of the present invention is not limited to the developer supply container 1 in the above described first embodiment removably mountable in a rotary type developing apparatus. For example, a developer supply container may be embodied as follows.

Next, the developer supply container 1 in the second embodiment of the present invention will be described.

Figure 6:
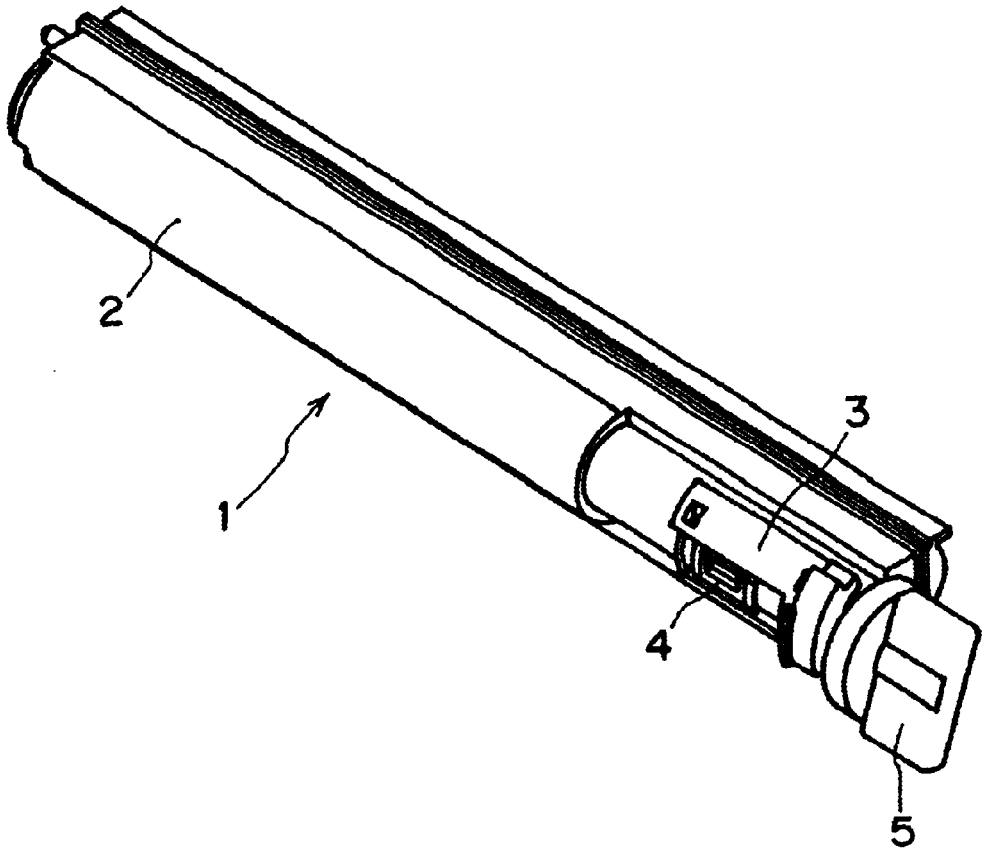
FIG. 6 is a perspective view of the developer supply container in the second embodiment of the present invention.
Figure 7:
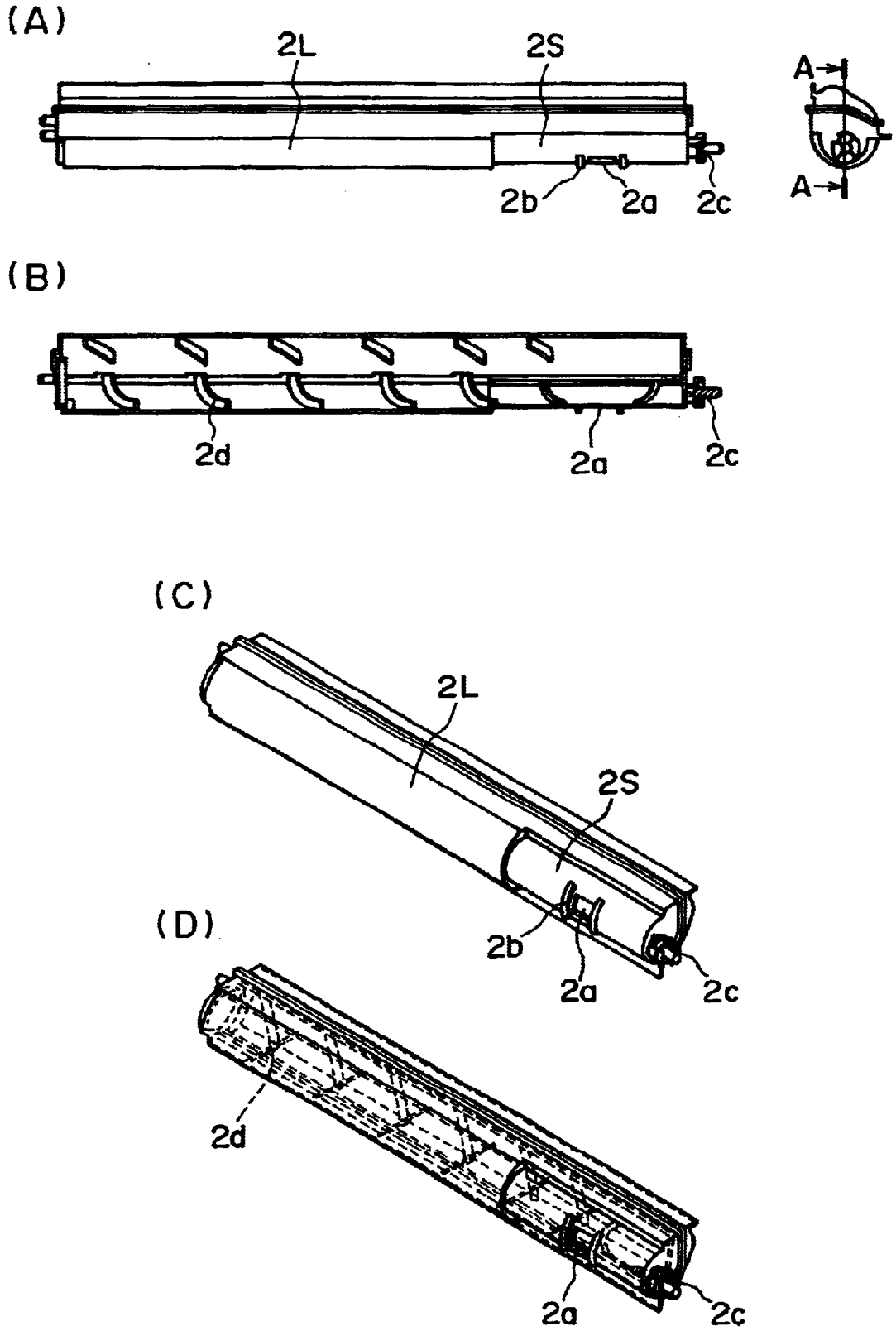
FIGS. 7(A), 7(B), 7(C), and 7(D) are front view, sectional view parallel to the end panels thereof, perspective view, and perspective phantom view, of the main assembly of the developer supply container, respectively.

Referring to FIG. 6, designated by a referential-numeral 1 is a cylindrical hollow developer supply container. The developer supply container 1 in this embodiment comprises a container main assembly 2, a shutter 3, a sealing member 4, and a knob 5.

(Container Proper)

Referring to FIGS. 7(A) through 7(D), the structure of the container main assembly 2 will be described. FIGS. 7(A), 7(B), 7(C), and 7(D) are a front view, sectional view parallel with the end panels thereof, perspective view, and perspective phantom view, of the main assembly of the developer supply container, respectively.

The container main assembly 2 has a developer outlet 2*a*, a shutter guide 2*b*, a knob guide 2*c*, and a plurality of particle conveyance ribs 2*d*.

As for the shape of the container main assembly 2 in terms of the sectional view, it is noncircular. More specifically, it looks as if it was formed by attaching a parallelepiped to a semicircle. The length of the container main assembly 2 is approximately 350 mm. The container main assembly 2 has two sections in terms of its lengthwise direction, one section being smaller in diameter than the other. The section with the smaller diameter has the developer outlet 2*a*.

Figure 8:
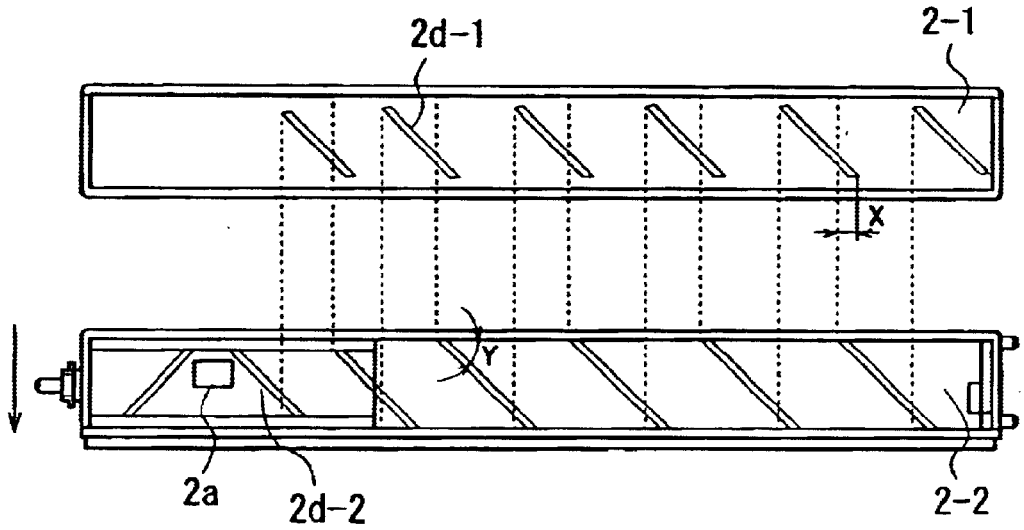
FIG. 8 is a drawing for describing the top and bottom members of the developer supply container in the second embodiment, as seen from the direction in which metallic molds are removed.
Figure 9:
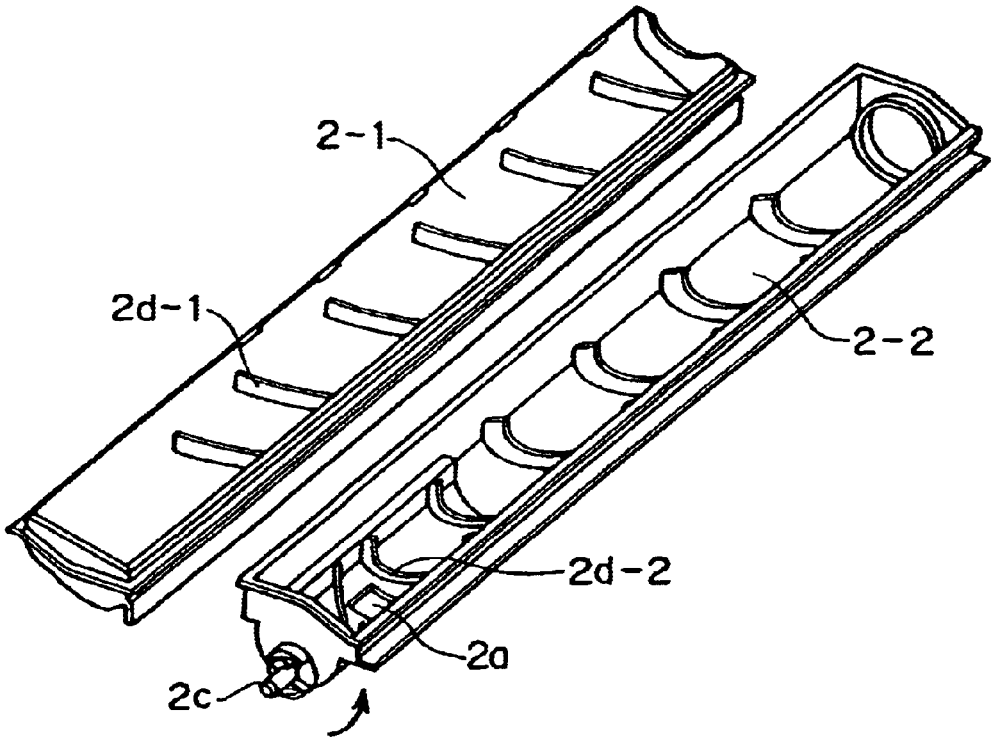
FIG. 9 is a drawing for describing the structures of the top and bottom members of the main assembly of the developer supply container in the second embodiment of the present invention.

Also in this embodiment, the container main assembly 2 is manufactured by welding the top and bottom members with the use of an ultrasonic welding method. The top and bottom members will be designated with referential numerals 2-1 and 2-2, respectively (FIGS. 8 and 9).

(Developer Outlet)

The opening of the developer outlet 2*a* is rectangular, and its size is 10 mm×15 mm. It is in the peripheral wall of the container main assembly 2. The developer in the container main assembly 2 is discharged through the developer outlet 2*a* into the corresponding developing device of the main assembly of an image forming apparatus.

Placing the developer outlet 2*a* in the peripheral wall of the container main assembly 2 can reduce the amount of the developer which cannot be discharged from the container main assembly 2, compared to a developer supply container having the developer outlet in one of its end walls.

Further, making the measurement of the developer outlet 2*a*, in terms of the lengthwise direction, shorter than the entire length of the container main assembly 2 can reduce the amount of the contamination traceable to the developer adhesion.

(Shutter Guides)

The shutter guides 2*b* are disposed next to the developer outlet 2*a* of the container main assembly 2, and are a pair of parallel ribs shaped so that their cross sections look like a key. The shutter 3 is engaged with these shutter guides 2*b* so that it can be moved about the axial line of the aforementioned semicircular portion of the container main assembly 2, following the curvature of the semicircular portion.

(Knob Guide)

The knob guide 2*c* is a disk-like rib, and is located at one of the lengthwise end portions of the container main assembly 2. The knob 5 is attached to the container main assembly 2 by engaging the claw portion (unshown) of the knob 5 with the knob guide 2*c*.

(Particle Conveyance Ribs)

The container main assembly 2 has a plurality of particle conveyance ribs 2*d* for conveying the developer in the container main assembly 2 toward the developer outlet 2*a*. The particle conveyance ribs 2*d* are erected in parallel on the internal surface of the peripheral walls of the container main assembly 2, which are curved with respect to the direction perpendicular to the lengthwise direction of the container main assembly 2. More specifically, the plurality of particle conveyance ribs 2*d* are grouped into two sets: the top and bottom sets separated in terms of the circumferential direction perpendicular to the lengthwise direction of the container main assembly 2. In this embodiment, the heights of the conveyance ribs belonging to the larger diameter section of the container main assembly 2 are 5 mm, whereas the heights of the conveyance ribs belonging to the smaller diameter section of the container main assembly 2 are 2.5 mm. The two sets of conveyance ribs are attached to the top and bottom members 2-1 and 2-2 of the container main assembly 2, respectively. The number of the conveyance ribs of the top member 2-1 is 6 and that of the bottom member 2-2 is 7 (FIGS. 8 and 9).

Organizing the conveyance ribs 2*d* into the above described two sets, or the top and bottom sets separated in terms of the circumferential direction perpendicular to the lengthwise direction of the container main assembly 2, as well as providing a gap between adjacent two conveyance ribs, makes it possible to efficiently loosen or fluff the body of developer so that the developer can be smoothly discharged from the developer outlet 2*a*.

Further, the container main assembly 2 in this embodiment can be manufactured by bonding the individually formed top and bottom members. In other words, the container main assembly 2 can be assembled from the minimum number of components, and therefore, its manufacture cost is lower.

(Top and Bottom Members of Container Main Assembly)

FIG. 8 is a drawing for describing the top and bottom members of the developer supply container in the second embodiment, as seen from the direction in which metallic molds are removed during the molding of the top and bottom members 2-1 and 2-2 of the container main assembly 2. The rotational direction of the developer supply container is as indicated by an arrow mark in FIG. 8.

All of the conveyance ribs 2*d*, except for one, of the top and bottom members of the container main assembly are tilted so that the developer outlet side end of each rib will be on the downstream side with respect to the direction in which the container main assembly is orbitally moved. Next, the angle of these conveyance ribs will be described with reference to the bottom member 2-2 of the container main assembly 2 shown in FIG. 9.

Referring to FIG. 8, in the case of the conveyance ribs of the bottom member 2-2 of the container main assembly 2, on the right side of the developer outlet 2*a*, their left side is where the developer outlet 2*a* is. Thus, they are tilted so that their left side will be on the downstream side with respect to the direction in which the container main assembly is orbitally moved. In FIG. 8, the orbital direction is downward. Thus, the conveyance ribs on the right side of the developer outlet 2*a* are such ribs that are tilted so that their left end portions are raised relative to their right end portions, in the drawing. In comparison, in the case of the conveyance rib on the left side of the developer outlet 2*a*, its right side is where the developer outlet 2*a* is. Thus, the conveyance ribs on the left side of the developer outlet 2*a* are such ribs that is tilted so that its left end portions are raised relative to its their right end portions, in the drawing.

Each of the conveyance ribs in the top and bottom members 2-1 and 2-2 of the container main assembly 2 is in the form of a piece of flat plate. In other words, it has such a shape that appears like a straight line, as seen the from the removal direction of the metallic molds during the molding of the top and bottom members 2-1 and 2-2.

Referring to FIG. 8, the positional relationship between the set of conveyance ribs 2*d* in the top member 2-1 of the container main assembly 2, and the set of conveyance ribs 2*d* in the bottom member 2-2 of the container main assembly 2, is as shown in the drawing. In other words, in terms of the axial direction of the rotary type developing apparatus, the conveyance ribs 2*d* in the top members 2-1 of the container main assembly 2 and the conveyance ribs 2*d* in the bottom member 2-2 of the container main assembly 2 are alternately positioned, whereas in terms of the direction perpendicular to the axial direction of the rotary type developing apparatus, the conveyance rib 2*d* and conveyance rib 2*d* partially overlap by their lengthwise end portions. The amount of the overlap (measurement of X in drawing), which here is measured as the length of the projection of any of the overlapping portions of the conveyance rib 2*d* and conveyance rib 2*d*, is roughly 5 mm. Therefore, it is assured that after being conveyed a certain distance by the conveyance ribs 2*d* of the top member 2-1, the developer particles are further conveyed by the conveyance ribs 2*d* of the bottom member 2-2, and then, after being conveyed a certain distance by the conveyance ribs 2*d* of the bottom member 2-2, they are further conveyed by the conveyance ribs 2*d* of the top member 2-1. In other words, the developer particles are conveyed toward the developer outlet through the alternate repetition of the above described conveyance processes. Thus, the phenomenon that a certain amount of the developer fails to be conveyed by falling off through the gap between the adjacent two conveyance ribs is prevented.

Therefore, the developer is conveyed at a higher speed and is discharged at a higher speed.

(Mounting of Developer Supply Container into Image Forming Apparatus)

Next, how the developer supply container 1 is mounted into an image forming apparatus, and the state of the developer supply container 1 in operation, will be described.

First, the developer supply container 1 is inserted into the image forming apparatus main assembly, with the developer supply container 1 positioned so that the knob 5 is on the front side (developer outlet is on front side).

Next, the container main assembly is to be rotated a predetermined angle in the direction indicated by an arrow mark, by grasping the knob proper portion of the knob 5 on the front end portion of the container main assembly. As the container main assembly is rotated, rotational force is transmitted to the gear of the shutter 3 from the gear of the knob 5 through the gear on the apparatus main assembly side. As a result, the shutter 3 is opened, exposing the developer outlet.

The positioning of the developer supply container 1 during the mounting of the developer supply container 1 into an image forming apparatus, and the method for mounting into an image forming apparatus, are not limited to the above described ones. In other words, the optimal position and method may be chosen in consideration of the structure of the main assembly of the image forming apparatus.

The developer supply container 1 is mounted into the rotary type developing apparatus in such a manner that it does not rotates about its axial line, and that it is orbitally moved about the axial line of the rotary type developing apparatus by the rotation of the rotary type developing apparatus. Thus, it is unnecessary to provide the container main assembly with a structure for receiving the force for rotational driving of the container main assembly. Therefore, not only is the developer supply container in this embodiment lower in cost, but also, it is capable of contributing to the cost reduction of the image forming apparatus main assembly.

(Operation of Developer Supply Container)

Next, referring to FIG. 10, the operation of the developer supply container 1 in this embodiment in the rotary type developing apparatus 201 will be described.

Figure 10:
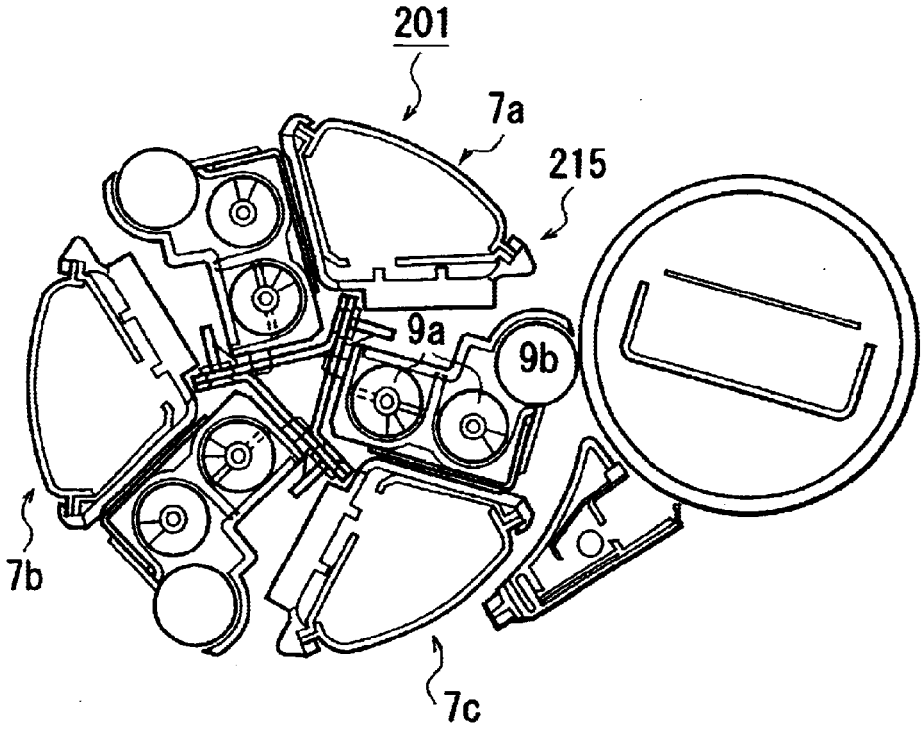
FIG. 10 is a front view of the rotary type developing apparatus, the internal space of which is divided in three sections.

Referring to FIG. 10, the structure and operation of the rotary type developing apparatus 201 will be described. The internal space of the rotary type developing apparatus shown in FIG. 6 is divided into three sections for holding three color developing devices 215 (Y, M, and C) and three developer supply containers 1, in the form of a roughly triangular pillar, corresponding thereto, one for one.

In the drawing, this rotary type developing apparatus rotates in the counterclockwise direction, and each rotational movement is limited to 120° so that as it stops, the designated developing device 215 is positioned to oppose the photoconductive drum. In this embodiment, the designated developing device 215 opposes the photoconductive drum at the location 7*a*, which hereinafter will be referred to as development station. The developer conveying member 9*a* and development sleeve 9*b* of each developing device 215 can be driven only when the developing device 215 is at the development station 7*a*; the driving force from the image forming apparatus main assembly is transmitted to the developing device 215 only when the developing device 215 is at the development station 7*a*. In other words, the developing devices 215 which are at the locations 7*b* and 7*c*, that is, the locations other the development station 7*a*, do not operate.

The developer supply container may be mounted or removed at any of these three locations. However, the locations other than the development station 7*a* are preferable. It is best for the developer supply container to be mounted or removed at the location 7*c* at which the opening of the developer outlet 2*a* faces upward. In this embodiment, therefore, the developer supply container is mounted or removed at the location 7*c*.

This rotary type developing apparatus is rotated 120° to switch developing devices. The time required for the switching is roughly 0.3 second, and the time during which the rotary type developing apparatus remains stationary for image formation is roughly 1.2 second. The peripheral velocity of the rotary type developing apparatus during its movement for developing device switch is approximately 0.7 m/second, and the diameter ϕ of the rotary type developing apparatus is 145 mm.

At this time, the test carried out to verify the differences, in terms of the developer discharge performance, among the developer supply containers (main assembles of developer supply containers) different in shape, will be described.

(Test)

In this test, one portion 2L of the container main assembly 2 of each of the two developer supply containers is given a large diameter and the other portion 2S (FIG. 7), and two portions 2L and 2S are connected so that across a certain range in terms of the circumferential direction of the container main assembly 2, the internal surface of the larger diameter portion 2L becomes level with the internal surface of the smaller diameter portion 2S. The test is carried out to prove that this structural arrangement improves the efficiency with which, and the manner in which, the developer is discharged from the developer outlet 2*a* of the smaller diameter portion 2S.

Figure 13:
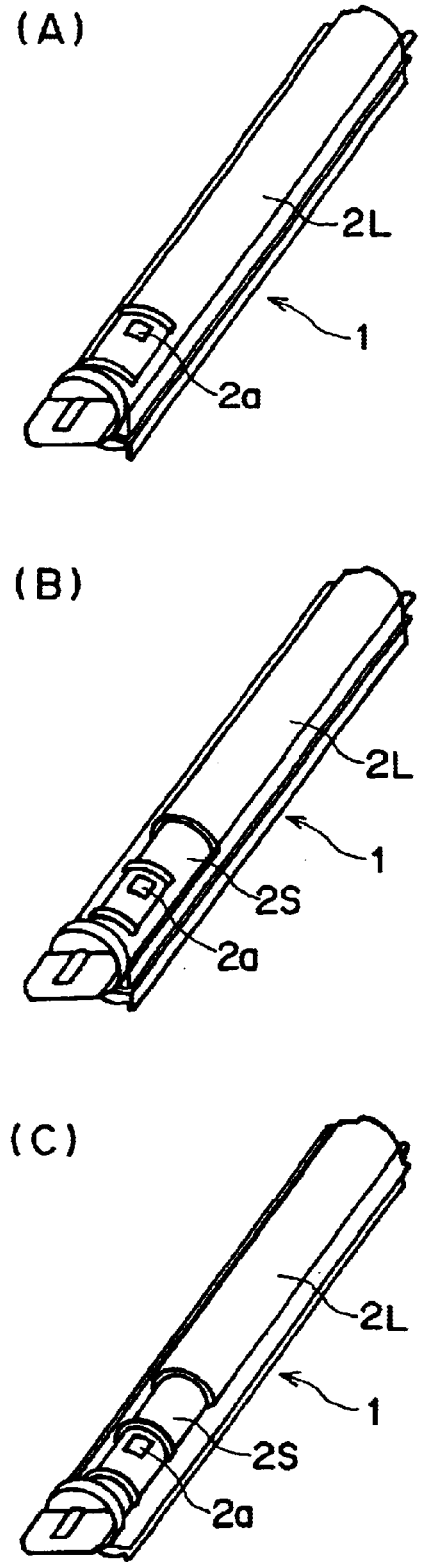
FIGS. 13(A), 13(B), and 13(C) are perspective view of the developer supply container having no small diameter portion (internal diameter $\phi$ of 36), perspective view of the developer supply container having a small diameter portion (internal diameter ϕ of 34), and perspective view of the developer supply container having a small diameter portion (internal diameter ϕ of 25).

This test was carried out using three developer supply containers, that is, a developer supply container (Φ36) with no smaller diameter portion, a developer supply container with a smaller diameter portion (Φ31), and a developer supply container with a smaller diameter portion (Φ25). The perspective views of the developer supply containers used in this test are given in FIGS. 13(A) through 13(C), in which 13(A), 13(B), and 13(C) represent the developer supply container 1 (Φ36) with no smaller diameter portion, developer supply container 1 with a smaller diameter portion (Φ31), and developer supply container 1 with a smaller diameter portion (Φ25), respectively.

Three developer supply containers (A), (B), and (C) were filled with developer so that they became equal in the bulk density of the developer therein at 0.43 g/cc (A: 185 g; B: 178 g; and C: 170 g), and were tested for developer discharge performance, with the use of a jig, a simplified form of the rotary type developing apparatus, (created by removing the developing devices from the rotary type developing apparatus so that the amount of the developer discharged from the developer outlet 2*a* of each developer supply container can be directly measured). The incremental rotational angle of the jig was set to 90°(90°×4; 90°→90°→90°→90°). Its moving time per 90° C. was set to roughly 0.3 second, and the time during which the jig was kept stationary for hypothetical image formation was set to roughly 1.2 second. The peripheral velocity of the jig during its movement for hypothetical developing device switch was set to approximately 0.7 m/second, and the diameter ø of the jig was 190 mm.

(Results)

With respect to the amount of the developer remaining in the developer supply container after the effective developer depletion from the developer supply container (discharging of developer was stopped when amount of developer discharged per incremental rotation of developing apparatus fell below 0.1 g), there were no differences among the above described three developer supply containers. However, the total number of rotations the container with no smaller diameter portion shown in FIG. 13(A) required to be depleted of the developer therein was roughly 120 times, whereas those for the developer supply container with the smaller diameter portion (internal diameter ϕ 31)in FIG. 13(B) and developer supply container with the smaller diameter portion (internal diameter ϕ 25) in FIG. 13(C) in accordance with the present invention were roughly 110 times and 70 times, respectively.

Figure 14:
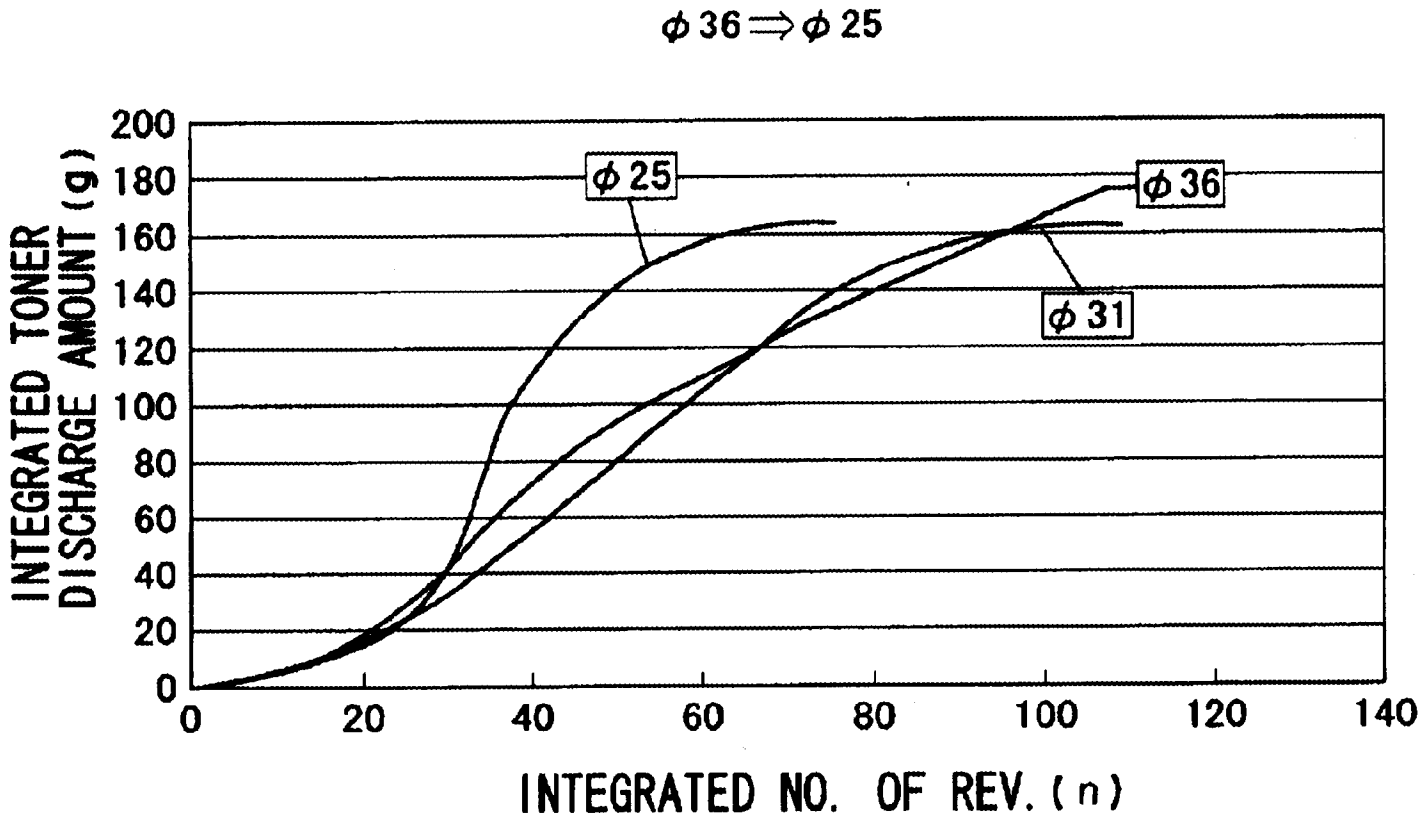
FIG. 14 is a graph showing the relationship between the cumulative amount of toner discharged from each of the three developer supply containers and cumulative nimber of rotations of the rotary type developin apparatus.

The results of this test were given in the form of a graph, in FIG. 14. It is evident from this graph that the ascending order of the three developer supply containers in terms of the developer discharge performance is: developer supply container with no smaller diameter portion→discharge supply container with small diameter portion (internal diameter ϕ 31)→developer supply container with smaller diameter portion (internal diameter ϕ 25).

(Analysis)

Figure 15:
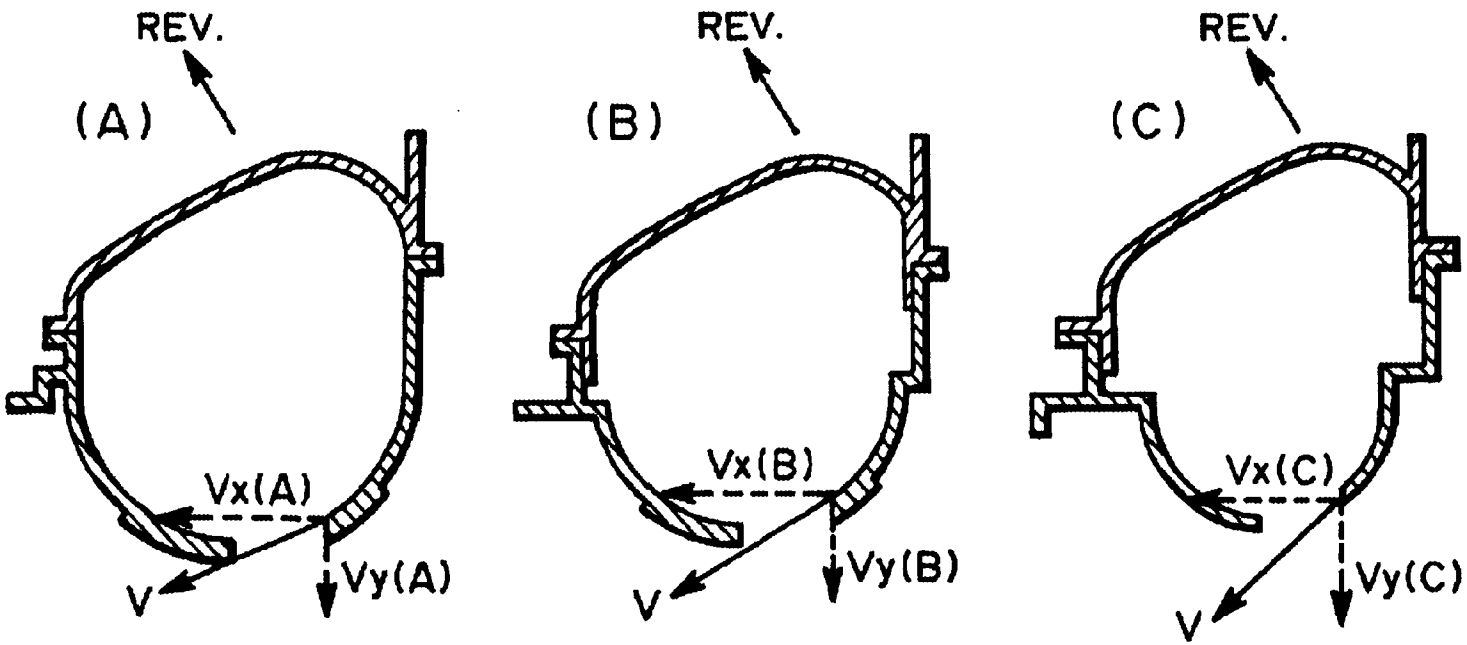
FIGS. 15(A), 15(B), and 15(C) are drawings for showing the ratio between the developer outlet and container proper of the developer supply container.

Next, the reasons for the above described results will be described based on the shapes of the developer supply containers. The ratio of the developer outlet 2*a* to the developer storage portion of the developer supply container 1 was increased by reducing the diameter of the section (first section) of the developer supply container 1, having the developer outlet 2*a*, to that of the other section (second section). Therefore, the developer discharge performance increased. FIGS. 15(A), 15(B), and 15(C) are sectional views of the developer supply containers shown in FIGS. 13(A), 13(B), and 13(C), at planes perpendicularly intersectional to the corresponding developer outlets 2*a*, respectively. The developer in each of the developer supply containers is conveyed to the adjacencies of the developer outlet, by the orbital movement of the developer supply container, and then, is discharged through the developer outlet. In the drawing, V stands for the velocity of the developer in the develop supply container during this orbital movement of the developer supply container 1; Vx stands for the horizontal component of V; and Vy stands for vertical component of V, that is, the component which acts in the direction to cause the developer to fall. The greater the ratio of the developer outlet 2*a* relative to the developer storage portion, the greater the component Vy. Thus, the greater the ratio of the developer outlet 2*a* relative to the developer storage portion, the greater the developer discharge performance. Further, in a certain range in terms of the circumferential direction of the developer supply container 1, the internal surface of the larger diameter portion 2L of the developer supply container 1 is level with that of the smaller diameter portion 2S of the developer supply container 1, allowing the developer to be smoothly conveyed from the larger diameter portion 2L to the smaller diameter portion 2S. Thus, the above described results were thought to have come from the synergetic effects of these two aspects of the structural arrangement in this embodiment. In addition, even if the developer is in the agglomerated state, the presence of step (vertical distance) between the internal surface of the larger diameter portion 2L and that of the smaller diameter portion 2L, in the range, other than the range in which the two surfaces are level, in terms of the circumferential direction of the developer supply container 1, loosens, fluidizing thereby, the agglomerated developer, adding thereby to the effects of the above described two aspects of the structural arrangement in this embodiment.

As described above, in this embodiment, the developer in the agglomerated state is loosened, that is, fluidized, by the stepped portion between a portion of the internal surface of the larger diameter portion 2L of the developer supply container 1 and a portion of the internal surface of the smaller diameter portion 2S of the developer supply container 1; the level connection between the other portion of the internal surface of the larger diameter portion 2L of the developer supply container 1 and the other portion of the internal surface of the smaller diameter portion 2S of the developer supply container 1 allows the developer to be smoothly conveyed from the large diameter portion 2L to the smaller diameter portion 2S; and the developer is smoothly discharged from the developer outlet 2*a* located in the semicylindrical wall portion of the smaller diameter portion 2S of the developer supply container 1. Thus, the employment of this embodiment of a developer supply container in accordance with the present invention will improve the developer discharge performance of a developer supply container without the cost increase traceable to the increase in component count, without increase in apparatus size, and without structural complication.

Also in the preceding embodiments, the section of the container main assembly 2 is noncircular, contributing thereby to the efficient utilization of the limited internal space of the rotary type developing apparatus. In other words, the embodiments increase the amount by which developer can be filled in each developer supply container, while leaving a rotary type developing apparatus unchanged in shape and internal space.

Further, the reduction of the diameter of the section of the container main assembly with the developer outlet increases the ratio of the developer outlet relative to the internal surface of the section with the developer outlet. Therefore, the developer supply container 1 is improved in the developer discharge performance.

Further, the provision of the step between a certain portion of the internal surface of the larger diameter portion of a developer supply container and a certain portion of the internal surface of the smaller diameter portion of the developer supply container loosens, fluidizing thereby, the agglomerated developer while the developer is conveyed from the large diameter portion to the smaller diameter portion. In addition, the portion of the internal surface of the developer supply container, opposite to the stepped portion of the internal surface across the internal space of the developer supply container, is level between the larger diameter portion and smaller diameter portion. Therefore, the developer is smoothly conveyed from the larger diameter portion to the smaller diameter portion. Further, the developer outlet is in the peripheral wall of the smaller diameter portion. Therefore, the developer is smoothly discharged through the developer outlet, after being smoothly conveyed to the developer outlet as described above.

In other words, according to this embodiment, the efficiency with which developer is discharged from a developer supply container is improved without altering the developer capacity of the developer supply container, and yet, the developer can be satisfactorily conveyed.

In other words, the developer discharge performance of a developer supply container can be further improved without the cost increase traceable to the increase in component count, without increase in apparatus size, and without structural complication.

Incidentally, the structure of a developer supply container may be such that, in terms of the lengthwise direction of the developer supply container, the portion of the container main assembly smaller in diameter than the rest of the container main assembly may be only as wide as the developer outlet.

Next, referring to FIGS. 16(A) and 16(B), the modifications of the preceding embodiments of a developer supply container in accordance with the present invention will be described.

The developer supply container in this modification of one of the preceding embodiments comprises the developer supply container in the preceding embodiment, and a plurality of baffling plates 12 in the form of a rib, which are protruding from the internal surface of the developer supply container, being aligned in the direction roughly parallel to the developer conveyance direction. The perspective views of the top and bottom members 2-1 and 2-2 of this developer supply container are given in FIG. 16(A). The structures of the portions of this developer supply container other than the top and bottom members 2-1 and 2-2 are the same as those of the developer supply container in the preceding embodiment, and therefore, will not be described here.

In this modification, the four baffling plates 12 are provided, which are disposed, one for one, in the four intervals of the conveyance ribs 2*d* of the top member 2-1 of the developer supply container.

(Baffling Ribs)

Figure 16:
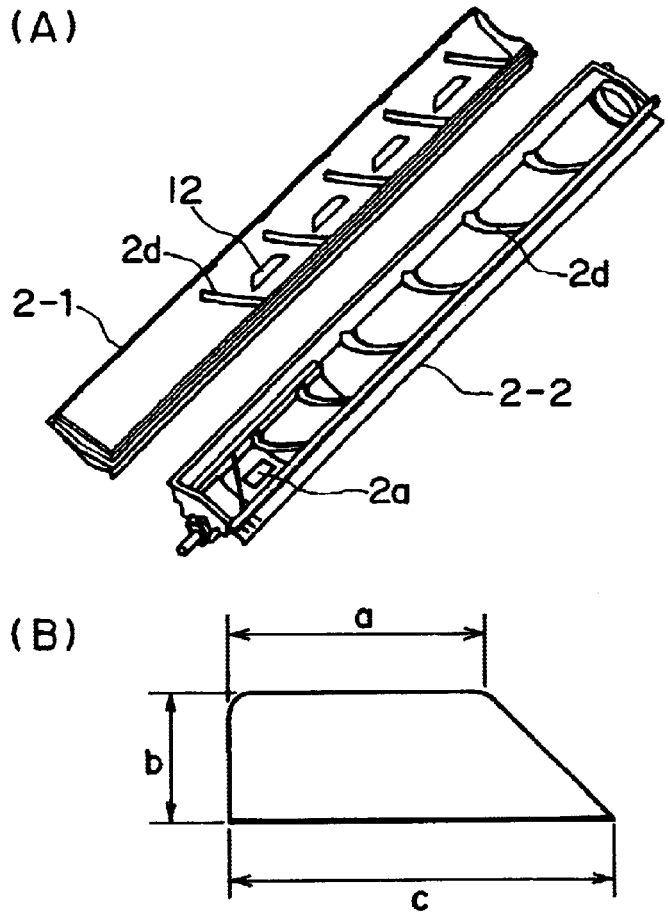
FIGS. 16(A) and 16(B) are drawings for showing the structures of the top and bottom members of the main assembly of the developer supply container, and the detailed drawing of the baffling plates.

Referring to FIG. 16(B), the baffling plates 12 will be described in detail. The measurements of the baffling plate 12 is as follows: a is 20 mm; b (height) is 10 mm; and c is 30 mm, The b side of the baffling plate 12 is the knob side, and the slanted edge side of the baffling plate 12 is the side corresponding to the developer inlet of the developer supply container.

This structural arrangement does not interfere with the filling of the developer into the developer supply container through the developer inlet located on the opposite side of the developer supply container with respect to the knob; it allows the developer to be smoothly filled in spite of the presence of the baffling plates 12.

The provision of the plurality of ribs, as baffling plates 12, effective to stir the developer, in the intervals of the conveyance ribs 2*d*, one for one, further improves the developer fluidity, stabilizing the developer discharge performance.

Figure 17:
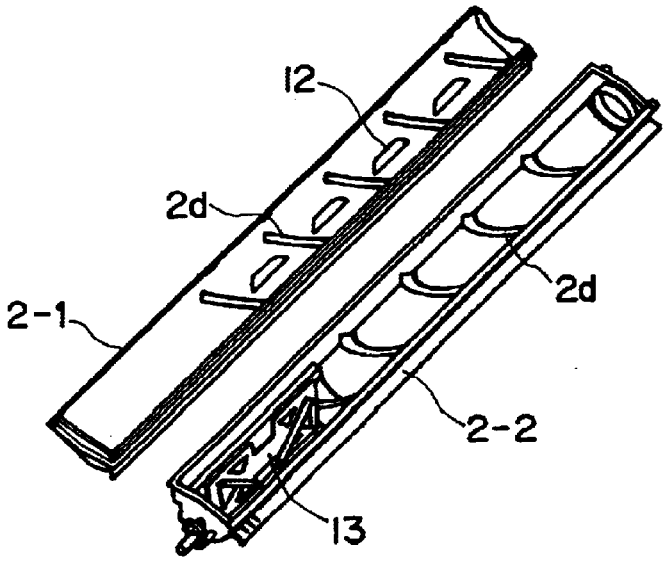
FIG. 17 is a drawing for showing the structure of the top and bottom members of the main assembly of the developer supply container.

Next, referring to FIGS. 17 and 18, another modification of the preceding embodiments will be described.

The developer supply container in this modification comprises one of the developer supply containers in the preceding embodiment, and a baffling member 13, as an additional stirring member, which is nonrotationally disposed adjacent to the developer outlet of the developer supply container. The perspective views of the top and bottom members 2-1 and 2-2 of this developer supply container are given in FIG. 17. The structures of the portions of this developer supply container other than the top and bottom members 2-1 and 2-2 are the same as those in the above described first and second embodiments, and therefore, will not be described.

(Baffling Member)

The baffling member 13 comprises: a baffler proper portion for lifting the developer as the developer supply container is orbitally moved; a guiding portion for guiding downward the developer lifted by the baffler proper portion, as the developer supply container is orbitally moved; a tilted plate portion 13*a* as a guiding portion for guiding downward, that is, toward the developer outlet (developer outlet 2*a*), the developer lifted by the baffler proper portion, as the developer supply container is orbitally moved; and a hole 13*b*, as a passage, through which the developer lifted by the baffler proper portion falls, without being conveyed toward the developer outlet (developer outlet 2*a*), as the developer supply container is orbitally moved.

Figure 18:
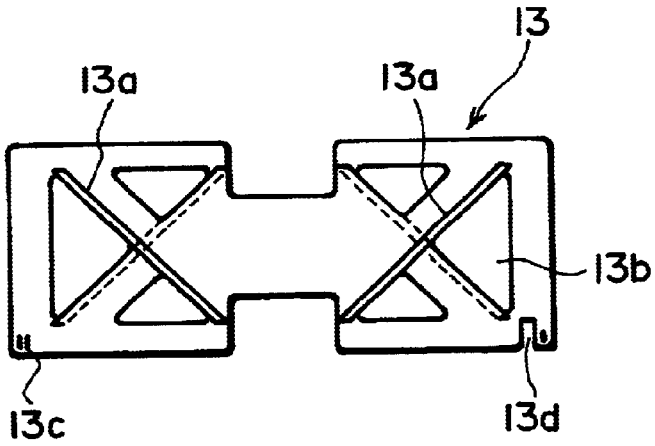
FIG. 18 is a detailed drawing of the baffling member.

FIG. 18 is a side view of the baffling member 13. The baffling member 13 comprises: the above described tilted plate portion 13*a* as a guiding portion; hole 13*b* as the developer passage; an anchor rib 13*c*; and a recess 13*d*. The baffling member 13 is orbitally moved by the rotation of the rotary type developing apparatus, while lifting the developer in the developer supply container by the baffler proper portion. A part of the lifted developer falls through the hole 13*b* after sliding on the baffling member 13, and the rest is conveyed toward the developer outlet by the tilted plate portion 13*a*.

Figure 19:
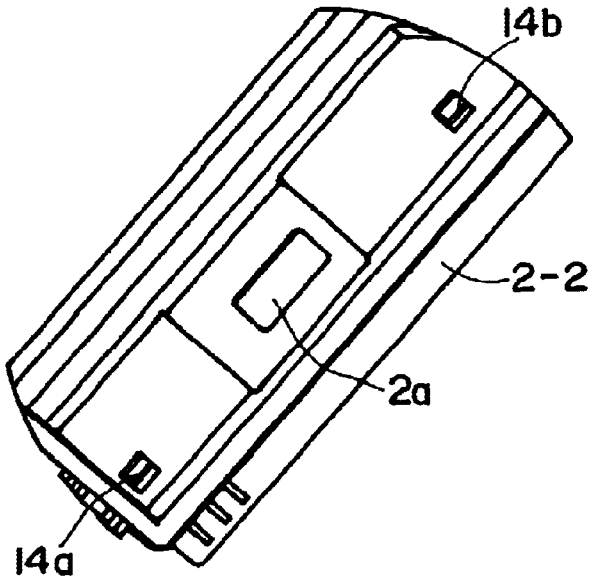
FIG. 19 is a detailed drawing of the baffling member anchoring portion of the developer supply container (bottom member).

Next, referring to FIGS. 18 and 19, the method for fixing the baffling member 13 to the developer supply container (bottom member 2-2) will be described. In order to attach the baffling member 13 to the developer supply container, the anchoring rib 13*c* of the baffling member 13 is engaged with a U-shaped rib 14*a* of the bottom member 2-2 of the container main assembly, and a square anchor rib 14*b* of the bottom member 2-2 of the container main assembly is engaged with the recess 13*d* of the baffling member 13 correspondent to the square rib 14*b*. This arrangement assures that the baffling member 13 is accurately attached to the bottom member 2-2 of the container main assembly; it prevents the baffling member 13 from being reversely attached.

Attaching the baffling member 13 to the adjacencies of the developer outlet (developer outlet 2*a*) assures that even after a developer supply container is subjected to harsh conditions, for example, high temperature, high humidity, severe vibrations, etc., during its shipment, the developer in the developer supply container is smoothly discharged through the developer outlet.

(Physical Properties of Developer)

If a developer supply container is subjected to severe vibrations during its shipment, or is left unattended for a long period of time under high-temperature and high-humidity conditions, the developer in the developer supply container becomes agglomerated or compacted, sometimes forming the so-called toner bridges. However, the above described developer supply containers in the first and second embodiments and the modifications thereof do not have a single or plurality of active stirring members, etc., that is, the means for breaking the toner bridges. Therefore, it is possible that the developer will not be satisfactorily discharged during the initial stage of the developer supply container usage. This possibility is particularly likely in the case of such developer that is greater in adhesiveness and agglomerativeness.

A developer supply container structured as described above conveys the developer therein by allowing the developer to slide on the flat tilted ribs, as the developer supply container is orbitally moved. Thus, it is not likely to be capable of efficiently conveying the developer which is greater in adhesiveness and agglomerativeness. In other words, when it is necessary to use such developer, a developer supply container structure as described above cannot fully display the above described superior functions thereof.

Further, if such developer is stored in the developer supply container structured as described above, it is likely to agglomerate at the developer outlet, and/or adhere to the developer outlet, blocking thereby the developer outlet. In an extreme case, it becomes impossible for the developer to be supplied.

Also, as described above, the positional relationship between the conveyance ribs 2*d*-2 in the adjacencies of the developer outlet 2*a* and the developer outlet 2*a* is such that with respect to the orbital movement of the developer supply container, the develop outlet 2*a* is on the downstream side of the conveyance ribs 2*d*-2, as shown in FIG. 5. Therefore, once the so-called toner bridges are formed by the developer agglomerated and/or compacted because a developer supply container was subjected to severe vibrations during its shipment, or was left unattended for a long period of time under high-temperature and high-humidity conditions, there will be no space, in the adjacencies of the developer outlet, for the developer to freely move. Without the space, in the adjacencies of the developer outlet, for the developer to freely move, the developer in the adjacencies of the developer outlet is not likely to be allowed to move, being therefore not likely to fluidize. As a result, the developer in the adjacencies of the developer outlet is likely to partially block the developer outlet, interfering the discharging of the developer. In an extreme case, it becomes impossible for the developer to be discharged through the developer outlet. This problem was particularly conspicuous when very adhesive and/or agglomerative developer was used.

Thus, first, developer in the powder form was analyzed with respect to its physical properties which make the developer preferable as the developer to be stored in a developer supply container structured as described above. Generally, the "agglomerativeness", or the degree of tendency to agglomerate, of developer, which is determined by measuring the ratio of the developer particles remaining on a sieve after the application of vibrations to the sieve bearing a body of developer, to the entirety of the body of developer, is used as the agglomeration index of the developer. The measuring method measures the amount of the residual particles after the application of the vibrations. Therefore, the values obtained using this measuring method do not accurately represent the ratio of the portion of the developer, which was agglomerated or compacted in a developer supply container by the severe vibrations during its shipment, or agglomerated or became compacted because the developer supply container was left unattended for a long period of time under high-temperature and high-humidity conditions. In other words, they are not closely related to the conveyability and dischargeability of the developer in the developer supply container.

Thus, the inventors of the present invention made further analyses, and as a result, the following discoveries were made. That is, the shear property and adhesion property of a layer of developer compacted at a certain ratio were closely related to the conveyability of the developer in a developer supply container, and the dischargeability of the developer therefrom. Further, they noticed that the uniaxial collapse stress and tensile strength of the powder substance layer were usable as the indices for the shear property and adhesion property of a layer of powdery substance. Then, they realized that when the developer supply containers in the preceding embodiments were used in combination with a developer, the values of the above described properties of which were within certain ranges, not only did the above described problems not occur at all, but also the effects of those developer supply containers were optimized by the synergy from the combination. In other words, a very desirable developer supply kit was attained. Next, the developer properties in accordance with the present invention will be described in detail.

The method used for measuring the uniaxial collapse stress and tensile strength of a developer will be described next. The equipment for the measurement was a powder bed tester (PTHN-13BA: Sankyo Dengyo, Co., Ltd.). As for the measurement environment, the temperature was 23° C., and the relative humidity was 50%.

Figure 11:
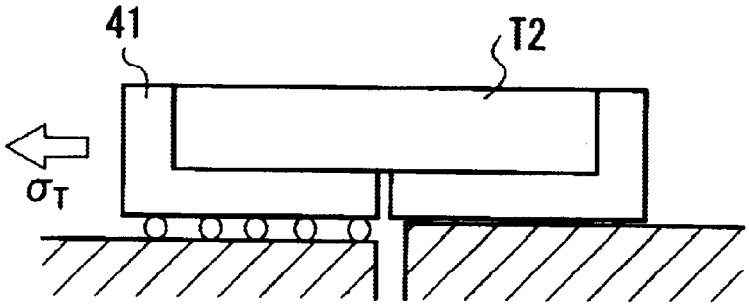
FIG. 11 is a drawing for describing the methods for measuring the adhesive strength and shear index of the developer.

First, a weight which could apply a vertical load (vertical stress) of 128 [g/cm$^2$] was placed on a body of developer for 10 minutes to compact it, forming a layer T2 of the developer (FIG. 11). Then, the developer layer T2 was measured in two ways which will be described next.

The developer in this embodiment is pure toner, or a mixture of toner and carrier. Thus, when the developer is pure toner, the powder layer has the same meaning as the toner layer, whereas when the developer is a mixture of toner and carrier, the powder layer means the mixture layer.

Regarding this vertical load, after the comprehensive tests, the inventors of the present invention experientially realized that in order to precisely mimic the bulk density of the developer having become compacted in a developer supply container during the shipment of the developer supply container and/or while the developer supply container were left unattended for a long period time, it was best to place a weight capable of applying 128 [g/cm$^2$], on the developer layer for 10 minutes.

Incidentally, the length of the time the weight is to be laid on the developer layer does not need to be 10 minutes. That is, as long as the plurality of values of the tensile strength and shear strength of the developer layer, obtained through the plurality of tests carried out to obtain the adhesive strength and shear index, do not show a substantial amount of deviation, the length of the time the weight is placed on the developer layer does not matter. In this embodiment, the tensile strength and shear strength of the developer layer were measured several times, and the averages of the obtained values were used as the tensile strength $\sigma T$ and shear strength $\tau$ of the developer layer.

(Method for Obtaining Tensile and Shear Strengths)

To explain concretely, referring to FIG. 11, a movable cell 41 is pulled at a slow speed in the direction of the arrow mark, and the amount of the force necessary to split the powder layer T2 is measured. The thus obtained value is used as the tensile strength $\sigma T$ of the powder layer T2.

Figure 12:
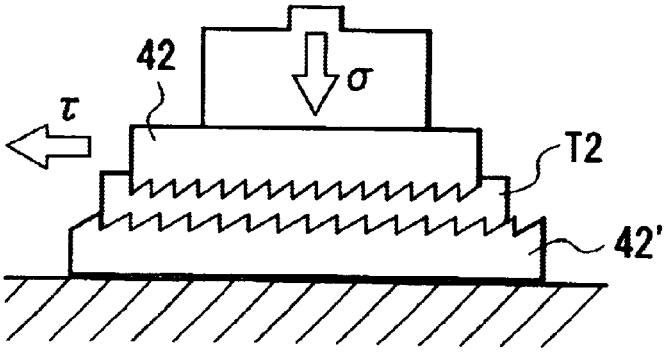
FIG. 12 is a drawing for describing the method for measuring the adhesiveness and shear index of the developer.

Next, referring to FIG. 12, a toothed supporting table 42' (formed of SUS) is disposed, with its toothed surface facing upward, and the powder layer T2 is formed on the toothed surface of the supporting table 42'. Then, a toothed movable plate 42 (formed of aluminum) is laid on the powder layer T2, with its toothed surface facing the powder layer T2. Then, in order to measure the shear strength $\iota$ of the powder layer T2, the movable plate 42 is horizontally moved while applying a vertical stress of $\sigma$ to the powder layer T2 from above. During this test, the powder layer T2 splits into the top and bottom layers having a thickness of the powder layer T2. The shear strength $\iota$ of the powder layer T2 is measured twice, the vertical load applied during the second measurement being different from that applied during the first measurement. Thus, two different values are obtained: $\iota i$ ($\iota 1$ and $\iota 2$). Incidentally, the shear strength $\iota$ is characterized in that it is larger at the initial period of the horizontal movement of the movable plate 42, and then, settles to a certain value (stable state). In this embodiment, the value obtained the moment the powder layer T2 begins to split into the top and bottom layers after the starting of the horizontal movement of the movable plate 42 is adopted as the shear strength of the powder layer T2.

(Calculation of Uniaxial Collapse Stress)

The shear index n and adhesive strength $\tau 0$ are obtained by substituting the measured value of the tensile strength $\sigma T$ and the measured values of the shear strengths $\tau 1$ (vertical stress $\sigma 1$) and $\tau 2$ (vertical stress $\sigma 2$), for the corresponding terms in the following Warren Spring equation (1). The definition of the uniaxial collapse stress, in $(\sigma, \tau)$ coordinate system, is the value of the intersection between the $\sigma$ axis, and the circle (Mohr's circle) to which the line obtained by substituting the values obtained by using the above described methods, for the terms in Warren Spring equation is tangential, and the center of which is on the $\sigma$ axis.

$$(\tau i/\tau 0)n=(\sigma i+\sigma T)/\sigma T(i=1, 2) \quad (1)$$

The toothed movable plate used to measure the shear strength in this embodiment was 1 mm in tooth height, and 1.5 mm in tooth pitch.

In this embodiment, the uniaxial collapse stress of the developer measured using the above described method is desired to be within a range of 2.0–8.0 [g/cm$^2$], for the following reason.

That is, if the uniaxial collapse stress of the developer is no more than 2.0 [g/cm$^2$], the phenomenon so-called flashing, that is, the phenomenon that the developer is discharged by an excessive amount the moment the developer outlet of a developer supply container is opened, is likely to occur. The occurrence of this phenomenon seriously contaminates the adjacencies of the joint between the developer outlet and developing device. In particular, the developer is likely to flash out all at once the moment the seal of the developer outlet of a developer supply container is removed.

In that instant, the developer flows by an excessive amount into the developer inlet of the developing device, making it impossible for the controlling apparatus to control the developer supply to the developing device. Also, if the uniaxial collapse stress of the developer is no more than 2.0 [g/cm$^2$], the developer does not settle in a developer supply container when filling the developer supply container with the developer. In other words, the apparent bulk density of the developer in the developer supply container is slow to reduce, making it difficult to fill the developer supply container with a predetermined amount of developer. This creates a problem during developer supply container manufacture.

On the other hand, if the uniaxial collapse stress of the developer is no less than 8.0 [g/cm$^2$], the developer tends to agglomerate, and therefore, it is highly possible for the developer outlet of a developer supply container to be blocked; it is highly possible that it will become impossible to discharge the developer from the developer supply container. In addition, if the uniaxial collapse stress of the developer is no more than 8.0 [g/cm$^2$], the amount by which the developer particles adhere to the developer supply container walls and conveyance ribs increases. As a result, the amount by which the developer remains unusable in the developer supply container increases.

For the reasons described above, in this embodiment, developer, the uniaxial collapse stress of which was in the range of 2.0–8.0 [g/cm$^2$] when the vertical stress of 128 [g/cm$^2$] was applied, is stored in a developer supply container structured as described above. As a result, even after the developer in the developer supply container agglomerates and/or becomes compacted in the developer supply container due to the vibrations during the shipment of the developer supply container and/or because the developer supply container is stored unattended for a long time in an environment in which temperature and humidity are high, the developer easily loosens, making it unnecessary to shake the developer supply container prior to developer supply container replacement, or to repeat a predetermined number of times the developer supplying operation. In other words, it becomes possible to continuously discharge the developer by a predetermined rate from the beginning of its usage to the depletion of the developer therein.

Further, the amount by which the developer remains unusable in the developer supply container, and the amount by which the developer adheres to the internal surface of the developer supply container is much smaller. In other words, virtually the entirety of the developer in the developer supply container can be discharged from the developer supply container.

Further, even after the developer in the developer supply container agglomerates and/or becomes compacted in the developer supply container due to the vibrations during the shipment of the developer supply container and/or because the developer supply container is stored unattended for a long time in an environment in which temperature and humidity are high, the developer can be easily loosened by the application of only a small amount of external force. Therefore, the developer is efficiently conveyed within the developer supply container, and is discharged from the developer supply container at a predetermined rate until the developer in the developer supply container is completely depleted.

Further, it becomes possible to prevent the developer outlet of a developer supply container from being partially or fully blocked by the developer in various environments.

(Shear Strength of Developer)

The tensile strength of developer is desired to be such that while a vertical stress of 128.4 [g/cm$^2$] is applied to the developer, it is in a range of 1.0–5.0 [g/cm$^2$], for the following reasons.

That is, if the shear strength of a developer is no more than 1.0 [g/cm$^2$], the developer tends to flash out of the developer outlet of a developer supply container. The occurrence of this phenomenon seriously contaminates the adjacencies of the joint between the developer outlet and developing device. In particular, the developer is likely to flash out all at once the moment the seal of the developer outlet of a developer supply container is removed. In that instant, the developer flows out by an excessive amount into the developer inlet of the developing device, making it impossible for the controlling apparatus to control the developer supply to the developing device.

On the other hand, if the shear strength of the developer is no less than 5.0 [g/cm$^2$], it is difficult for the developer to be efficiently conveyed, because the developer supply container in this embodiment is structured so that the developer is conveyed as it slides on the tilted ribs. In addition, the discharge velocity is slower. Therefore, the amount by which the developer particles adhere to the developer supply container walls and conveyance ribs is greater. Consequently, the amount by which the developer remains unusable in the developer supply container is greater. Moreover, if a developer supply container containing developer is subjected to the vibrations during the shipment of the developer supply container and/or while the developer supply container is stored unattended for a long time in an environment in which temperature and humidity are high, the developer agglomerates and/or becomes compacted in the developer supply container, increasing thereby the adhesive strength among the developer particles. Consequently, even when the developer supply container is orbitally moved, the developer in the developer supply container does not loosen, failing therefore to be discharged from the developer supply container.

For the reasons described above, in this embodiment, developer, the shear strength of which is in the range of 1.0–5.0 [g/cm$^2$] when the vertical stress of 128 [g/cm$^2$] is applied, is stored in a developer supply container structured as described above. As a result, the amount by which the developer remains unusable in the developer supply container, and the amount by which the developer adheres to the internal surface of the developer supply container is even smaller than the amount to which it is reduced by the above described effects. In other words, virtually the entirety of the developer in the developer supply container can be discharged from the developer supply container.

Incidentally, the method for setting the uniaxial collapse stress and shear strength of the layer of the above described developer to predetermined values does not need to be limited to the above described one. For example, it is possible to reduce the size of the contact area between given two developer particles. In order to do so, such agent that increases developer fluidity is to be added. However, a method for reducing the contact area by controlling the developer particle shape is preferable.

(Average Particle Diameter of Fluidizing Agent)

In order to fluidize developer so that the developer can be efficiently discharged from a developer supply container, it is desired that at least one among the following fluidizing agents is externally added to toner particles: fine powders of dehydrated silica, alumina, and titanium oxide.

The addition of the fluidizing agent or agents to developer reduces the agglomerativeness and adhesiveness of the developer. Further, the fluidizing agents are dehydrated, and therefore, they cancel the effects of the moisture, preventing thereby the developer agglomeration. Further, the addition makes it possible to keep the chargeability of the developer at a desirable level for a long period of time, regardless of ambience.

The average primary particle diameter of the fluidizing agent is desired to be in a range of 1–100 [nm], preferably, in a range of 4–80 [nm], for the following reasons.

That is, if the average primary particle diameter of a fluidizing agent is no more than 1 [nm], the fluidizing agent particle is likely to settle in the recesses of the surface of each developer particle as they are externally added to the developer. Therefore, the fluidizing agent fails to reduce the adhesiveness and agglomerativeness of the developer, failing therefore to prevent the occurrence of unsatisfactory image transfer.

If the average primary particle diameter of a fluidizing agent is no less than 100 [nm], the developer is more agglomerative, and is nonuniformly charged, resulting in the electrostatic agglomeration of the developer. Further, such problems as fog formation, scattering of the developer, etc., occur.

The average primary particle diameter of a fluidizing agent is measured using the following method. That is, the fluidizing agent particles are observed using a transmission electron microscope, and 100 particles, which are no less than 1 [nm] in diameter, are picked in the field of view. Then, the average diameter of the 100 particles is adopted as the average primary particle diameter of the fluidizing agent.

It is desired that these fluidizing agents in fine particle form are externally added to a developer at a ratio of 0.03–5 units of mass of the fluidizing agent to 100 units of mass of toner particles. When the ratio at which the fluidizing agent is externally added to a developer is within this range, the surface of a given toner particle is covered with the fluidizing agent at a proper ratio, and therefore, the toner particles are prevented from adhering to the adjacent toner particles; in other words, they are prevented from agglomerating.

(Degree of Circularity of Developer)

A developer to be stored in a developer supply container structured as described above is desired to be such a developer that, in terms of the number based cumulative value, no less than 80% of the particles of the developer is no less than 0.900 in the circularity degree a defined by the following equation (2), preferably, no less 67% of the particles of the developer is no less than 0.95 in the same circularity degree a, for the following reasons.

That is, when, in terms of the number based cumulative value, the particles, the circularity degree of which is no less than 0.900 is no less than 80%, the contact area between given two particles is substantial, and therefore, the friction between the given two particles is substantial. Thus, once the developer agglomerates during the shipment, the application of a small amount of force is not enough to loosen the agglomerated developer. In other words, once such a developer becomes agglomerated in such a developer supply container as the developer supply container in this embodiment, which does not have an active stirring member, the developer supply container cannot loosen the agglomerated developer, being therefore unable to discharge the developer. In addition, such a developer is not likely to smoothly slide on the tilted conveyance ribs, reducing therefore the developer conveyance efficiency. Further, the usage of such a developer reduces transfer efficiency.

For the above described reasons, in this embodiment, such a toner that, in terms of the number based cumulative value, no less than 80% of the particles of the developer is no less than 0.900 in the circularity degree a (=L0/L, wherein L1 represents circumference of circle equal in size to projected image of particle, and L represents circumference of projected image of particle) is employed as the toner with which the developer supply container structured as described above is filled. Therefore, it is possible to efficiently loosen the developer therein, and discharge the developer therefrom, even after the developer in the developer supply container agglomerates and/or becomes compacted in the developer supply container due to the vibrations during the shipment of the developer supply container and/or because the developer supply container is stored unattended for a long time in an environment in which temperature and humidity are high.

In this embodiment, the concept of the average circularity degree of a developer is employed as a simple way of quantitatively showing particle shape. In this embodiment, the average circularity degree of a developer is measured using a flow type particle image analyzer FPIA-1000 (Toaiyo-denshi, Co., Ltd.). The circularity degree of each measured particle is obtained using the following equation (2). The definition of the average circularity degree of a developer is the value obtained by dividing the total value of the circularity degrees of all the measured particles by the total number of the measured particles. L0 stands for the circumference of a circle equal in size to the projected image of a particle, and L stands for the circumferential of the particle.

$$\text{Circularity Degree } a = L0/L \quad (2)$$

The circularity degree in this embodiment is an index for showing the irregularity of toner shape. It is 1.00 when a toner particle is perfectly spherical, and the more irregular, that is, complex, the shape of a toner particle, the smaller the circularity degree of the toner particle. Further, the standard deviation of the circularity degree distribution of the developer in this embodiment is an index for showing the toner shape deviation. The smaller it is, the sharper the distribution.

The apparatus FPIA-1000 used for measuring the circularity degree of a developer uses the following method to calculate the average circularity degree and the standard deviation of the circularity degree, after calculating the circularity degree of each particle. That is, the particles are classified according to circularity degree into 61 circularity degree classes ranging from 0.4–1.0. Then, the average circularity degree, and standard deviation of the circularity degree, of a developer is calculated based on the center value and frequency of each class. The differences between the values of the average circularity degree and standard deviation of the average circularity degree calculated using this method, and the corresponding values of those obtained using the above described mathematical formula into which the circularity degree of each particle is directly entered, are very small, being virtually negligible. Thus, in this embodiment, the calculating method using the mathematical formula (2), that is, a calculating method obtained by slightly modifying the concept of the above described method using the mathematical formula in which the circularity of each particle is directly entered, may be employed.

To concretely describe the measuring method, 0.1–0.5 [ml] of surface-active agent as dispersant, preferably, alkylbenzene sulfonate, is added to 100–150 [ml] of water, from which impurities have been removed in advance. Next, 0.1–0.5 [g] of the sample of the substance to be measured is added to the mixture. Then, the suspension containing the sample, is processed with an ultrasonic dispersing machine for roughly 1–3 minutes, realizing a dispersion density of 12,000–20,000 [particles/$\mu$]. Then, the circularity degree distribution of the particles, the sizes of the projected images of which are equivalent to the sizes of circles, the diameters of which are no less than 0.60 [$\mu$m] and no more than 159.21 [$\mu$m], are measured using the above described flow type particle image analyzer.

The outline of the measuring method is given in the catalog (published in June, 1995) of FPIA-1000 published by Toa-iyo-denshi Co., Ltd., and the operation manual of the measuring apparatus. It is also disclosed in Japanese Laid-open Patent Application 8-136439. It is as follows.

The sample containing suspension is flowed along the path (extending in the flow direction) of a flat transparent flow cell (roughly 200 [$\mu$m] in thickness). A strobe and a CCD camera are disposed in a manner to sandwich the flow cell so that the path of the light from the strobe becomes perpendicular to the thickness direction of the flow cell. In order to obtain the images of the particles while the sample containing suspension flows through the flow cell, the strobe is fired once every 1/30 of a second. As a result, the image of each particle is captured as a two-dimensional image, which is parallel to the flow direction of the flow cell, and which has a size corresponding to the size of the particle. Then, based on this two-dimensional image of each particle, the diameter of such a circle that is equal in area size as this two-dimensional image of each particle is calculated. Then, the circularity degree of each particle is calculated using the circumference of the two-dimensional image, that is, the projected image, of each particle, and the above described mathematical equation for calculating the circularity degree.

The method for manufacturing a toner, the circularity degree of which is in a predetermined range, is not limited. For example, in order to manufacture such a toner with the use of a pulverization method, a mixture containing at least bonding resin and a coloring agent is melted, kneaded, and cooled. Then, the cooled mixture is pulverized. Thus, all that is necessary to manufacture such a toner is to use the correct pulverizing apparatus. As for the choices of a pulverizing Apparatus, there are jet grinding apparatus, in particular, jet grinding apparatuses of collision type, which use jet stream, mechanical pulverizing apparatuses, etc. The thus manufactured toner may be modified in shape with the use of a hybridizer.

Instead of a pulverizing method, a polymerization method may be used, in which a mixture containing monomers, which can be polymerized, a coloring agent, and wax, is subjected to a polymerization process to directly obtain toner particles with desired properties.

This embodiment is compatible with magnetic toner, the particles of which internally contain magnetic substance, as well as nonmagnetic toner. It also is compatible with a mixture of toner and carrier.

(Amount of Wax)

In recent years, the need for higher speed and higher image quality have been rapidly growing in the field of full-color image forming apparatuses. Thus, frequently, such a substance as wax that is superior in releasing capacity is added to toner in order to better prevent developer from offsetting during fixation, and also to improve color developer mixture. Needless to say, the developer supply container in this embodiment is also compatible with such a high speed image forming apparatus as those described above. In other words, the usage of a developer containing wax causes no problem, as long as the uniaxial collapse stress and shear index of the developer to be stored in the developer supply container in this embodiment are within the range specified in this embodiment.

In the case of a wax containing developer, the ratio of wax is desired to be 0.5–30 units of mass of wax per 100 units of mass of the bonding resin of the toner, for the following reason.

That is, the addition of wax at a ratio of no more than 0.5 unit of mass negatively affects the developer fixation at a low temperature, flocking resistance, and offset resistance, whether a pulverization method or a polymerization method is used.

On the other hand, if wax is added at a ratio of no less than 30 units of mass when a pulverization method is employed, the wax is dispersed in the bonding resin, and is present on the surface of a toner particle. Therefore, the developer is inferior in adhesiveness and agglomeration. Further, it will result in the presence of a substantial amount of free wax in the developer, and this free wax will adhere to the tilted ribs and internal surface of the developer supply container, negatively affecting the developer conveyance efficiency. In addition, the free wax may weld itself to the development sleeve. Further in the case of a two-component developer, the free wax contaminates the carrier, adversely affecting the chargeability of the carrier.

For the reasons given above, in this embodiment, a developer, in which the ratio of wax content is 0.5–3.0 units of mass per 100 units of mass of the bonding resin of the toner, is chosen as the developer to be stored in the developer supply container. Therefore, not only is it possible to provide a developer supply container, which is not affected, in the developer loosening performance and developer discharging efficiency, even if the developer in the developer supply container agglomerates and/or becomes compacted in the developer supply container due to the vibrations during the shipment of the developer supply container and/or because the developer supply container is stored unattended for a long time in an environment in which temperature and humidity are high, but also, it is possible to improve an image forming apparatus in developer offset resistance during fixation, and color developer mixture.

(Carrier Content)

In a two-component developing method, in order to prevent a developer from deteriorating in chargeability, a fresh supply of carrier or a mixture of toner and carrier is supplied into a developing device at regular intervals or continuously. With this practice, it is possible to prevent the developer in a developing device from deteriorating in chargeability, prolonging the cartridge replacement interval or making it possible to completely eliminate the cartridge replacement.

The developer stored in a developer supply container mounted in an image forming apparatus structured as described above is naturally a mixture of toner and carrier. Storing, as a developer, a mixture of toner and carrier in a developer supply container in this embodiment causes no problem. The carrier content of such a developer that is a mixture of toner and carrier is desired to be no more than 40% in weight of the entire weight of the developer, for the following reason. That is, if a developer, the carrier content of which is greater than 40 wt. %, is stored in the above described developer supply container in this embodiment; the toner is likely to segregate from the carrier, which is a problem.

In other words, as long as the carrier content of a two-component developer is kept below 40 wt. % (5–40 wt. %) of the entirety of the developer, the toner is not likely to segregate from the carrier.

(Examples of Developer Storable in Developer Supply Container in Accordance with Present Invention)

Next, concrete examples of a preferable developer to be stored in a developer supply container in accordance with the present invention will be described. The values of the properties of various developers (toners) described below as examples are as shown in the following Table 1, in which toners A, B, and C are the examples of a developer in accordance with the present invention, and which will be described in the listed order.

TABLE 1

| | UNIAXIAL COLLAPSE STRESS ($g/cm^2$) | ADHESION STRENGTH ($g/cm^2$) | CIRCULARITY (%) |
|---|---|---|---|
| TONER A | 2.3 | 1.03 | 95 |
| TONER B | 3.5 | 1.6 | 86 |
| TONER C | 4.5 | 2.6 | 92 |
| TONER D | 8.5 | 4.8 | 79 |

(Toner A)

Nine hundreds units of mass of ion-exchange water, and 450 units of mass of water solution of $Na_3PO_4$ (0.1 [mol/l]), were poured into the four-mouthed two-liter flask of a high speed stirring apparatus TK (homo-mixer). The revolution of the mixing apparatus was adjusted to 12,000 [rpm], and the temperature of the mixture was raised to 65 [° C.]. Then, 68 units of mass of water solution of $CaCl_2$ (1.0 [mol/l]) were gradually added to the mixture to concoct a water based medium, which contains a trace amount of $Ca_3(PO_4)_2$ (which is difficult to dissolve in water), and the pH of which was 9.

| | |
|---|---|
| Styrene: | 180 units of mass |
| 2-ethylhexylacrylate: | 20 units of mass |
| Coloring agent (copper-phthalocyanine): | 12 units of mass |
| Metallic compound of di-tert-butyl-salicylic acid: | 2 units of mass |

-continued

| | |
|---|---|
| Polyester resin: | 15 units of mass (acid value: 5, peak molecular weight: 7,000) |
| Ester wax (melting point: 60° C.): | 20 units of mass |
| Di-vinyl-benzene: | 0.8 units of mass |

The above compound was subjected to a dispersing process with the use of an atomizer for three hours. Then, 4 units of mass of 2,2'-azobis (2,4-dimethyl-valeronitrile), that is, a polymerization initiator, were added to the dispersed medium. Then, the compound was subjected to a particle making process for 12 minutes at a revolution of 12,000 [rpm]. Then, the high speed stirring blade of the high speed stirring apparatus was replaced with a propeller type stirring blade, and the suspension polymerization process was allowed to continue for five hours at an internal temperature of 65 [° C.] and at a revolution of 500 [rpm]. Then, 2 units of mass of potassium persurlfate was added to modify, in surface properties, the particles resulting from the polymerization process. Then, the internal temperature was raised to 80 [° C.] and the process was allowed to continue for five hours.

After the completion of the suspension polymerization process and surface treating process, the slurry was cooled. Then, diluted hydrochloric acid was added to dissolve calcium phosphate.

Toner particles were separated by filtration, were washed, and then, were dried, obtaining cyan toner particles (toner particle 1).

The bonding resin of the obtained toner particles was 60 [° C.] in Tg. The average degree of circularity of the cyan toner particles was 0.985.

Next, external additive was added to the obtained toner particles at a ratio of 3 parts to 100 parts. Then, the coarse particles were removed with the use of a 330 mesh filter, obtaining thereby cyan toner (toner A) which normally holds negative charge. The weight average particle diameter of the toner 1 was 7.1 [$\mu$m].

First fine particles of hydrophobic silica 0.3 unit of mass: 100 units of mass of fine particles of silica, which were 170 [$m_2/g$] in the surface area in terms of BET ratio, 12 [nm] in number average particle diameter, were made hydrophobic with the addition of 20 units of mass of hexamethyldisilazane, in a gaseous medium.

Second fine particles of hydrophobic silica 0.7 unit of mass: 100 units of mass of fine particles of silica, which were 70 [$m_2/g$] in the surface area in terms of BET ratio, 30 [nm] in number average particle diameter, were made hydrophobic with the addition of 10 units of mass of hexamethyldisilazane in a gaseous medium.

Fine particles of hydrophobic titanium oxide 0.4 unit of mass: 100 units of mass of fine particles of titanium oxide, which were 100 [$m_2/g$] in the surface area in terms of BET ratio, 45 [nm] in number average particle diameter, were made hydrophobic with the addition of 10 units of mass of hexamethyldisilazane in a water based medium.

(Toner B)

| | |
|---|---|
| Polyester resin: | 100 units of mass |
| Charge controlling agent: | 2 units of mass |
| Wax: | 5 units of mass |
| Copper-Phthalocyanine: | 7 units of mass |

were preliminarily mixed with the use of a powder mixing apparatus. Then, the mixture was placed in a biaxial extruding machine, thermally melted, kneaded, and cooled. Then, the cooled mixture was pulverized, with the use of a hammer mill, into coarse particles, the particle diameter of which was roughly in a range of 1–2 [nm]. Then, the coarse particles were pulverized with the use of a jet stream type pulverizing machine. Next, excessively fine particles and coarse particles were strictly eliminated from the obtained fine particles by putting the obtained particles through a classifying machine, obtaining cyan toner particles. The volume average particle diameter of the resultant cyan toner particles was 7.6 [μm].

Next, 1.0 unit of mass of hydrophobic titanium oxide with an average particle diameter of 5 [nm] was externally added to 100 units of mass of the obtained cyan toner particles, using a Henschell mixer, obtaining cyan toner B.

(Toner C)

Hybrid resin comprising polyester units and vinyl

| | |
|---|---|
| polymer unit: | 100 units of mass |
| Charge controlling agent: | 2 units of mass |
| Wax: | 5 units of mass |
| Copper-phthalocyanine: | 7 units of mass |

were preliminarily mixed with the use of a powder mixing apparatus. Then, the mixture was placed in a biaxial extruding machine, thermally melted, kneaded, and cooled. Then, the cooled mixture was pulverized, with the use of a hammer mill, into coarse particles, the average diameter of which was roughly in a range of 1–2 [nm]. Then, the coarse particles were pulverized with the use of a mechanical pulverizing machine. Next, excessively fine particles and coarse particles were strictly eliminated from the obtained fine particles by putting the obtained particles through a classifying machine, obtaining cyan toner particles. The volume average particle diameter of the obtained cyan toner particles was 7.2 [μm].

Next, 1.0 unit of mass of hydrophobic titanium oxide with an average particle diameter of 5 [nm] was externally added to 100 units of mass of these cyan toner particles, using a Henschell mixer, obtaining cyan toner C.

(Formulation of Toner D)

| | |
|---|---|
| Styrene-acrylic resin: | 100 units of mass |
| Magnetic particles with an average particle diameter of 0.05 μm: | 90 units of mass |
| Wax: | 10 units of mass |

were preliminarily mixed with the use of a powder mixing apparatus. Then, the mixture-was placed in a biaxial extruding machine, thermally melted, kneaded, and cooled. Then, the cooled mixture was pulverized, with the use of a hammer mill, into coarse particles, the average diameter of which was roughly in a range of 1–2 [nm]. Then, the coarse particles were pulverized with the use of a jet mill. Next, excessively fine particles and coarse particles were strictly eliminated from the obtained fine particles by putting the obtained particles through a classifying machine, obtaining toner particles. The volume average particle diameter of the obtained magnetic toner particles was 9.8 [μm]. Next, 1.0 unit of mass of hydrophobic titanium oxide with an average particle diameter of 5 [nm] was externally added to 100 units of mass of these toner particles, using a Henschell mixer, obtaining cyan toner D.

(Dischargeability of Developer)

Next, the results of the tests carried out to examine how the developer supply containers structured as described in the first and second embodiments discharge the toner therein, when the above described examples of toner were stored therein, will be described.

[Test 1]

The developer supply container structured as described in the first embodiment was filled with the toner A so that the ratio of the toner A in the developer supply container relative to the internal volume of the developer supply container became 0.43 [g/cc]. Then, the developer supply container was tested for toner discharge performance, using a simplified rotary type toner discharging jig (created by removing the developing devices from the rotary type developing devices so that the amount of the developer discharged from the developer outlet of each developer supply container can be directly measured). The incremental rotational angle of the developer amount measurement jig was set to 120°×3 (120°→120°→120°). The time during which the jig was kept stationary was set to roughly 0.3 second. The peripheral velocity of the jig during its movement was set to approximately 0.7 [m/s]. The toner was excellently discharged from the beginning, and virtually the entirety of the developer in the developer supply container was discharged. In other words, the amount by which the developer remained unusable in the developer supply container was very small, and there were virtually no developer particles remaining adhered to the internal surface of the developer supply container wall.

Next, the developer supply container structured as described in the first embodiment was filled with the toner A so that the ratio of the toner A in the developer supply container relative to the internal volume of the developer supply container became 0.43 [g/cc]. Then, the developer supply container was laid on its side, and was tapped 1,000 times. Then, the developer supply container was subjected to the same toner discharge performance test as the one described above. Although the developer in the developer supply container was in the compacted state, blocking the developer outlet prior to the rotation of the developer supply container, it quickly became uncompacted as soon as the developer supply container began to be rotated. Thereafter, the toner was discharged in the preferable manner, and the developer outlet was rarely blocked by the developer. Virtually the entirety of the developer in the developer supply container was discharged. In other words, the amount of the developer which remained unusable in the developer supply container was extremely small, and virtually no developer particles remained adhering to the internal surface of the developer supply container wall.

[Test 2]

The developer supply container in the first embodiment was filled with the toner B so that the ratio of the toner B in the developer supply container relative to the internal volume of the developer supply container became 0.40 [g/cc]. Then, the developer supply container was subjected to the same toner discharge performance test as the one carried out in Test 1. Also in this test, the toner was discharged in the preferable manner from the beginning, and the developer outlet was rarely blocked by the developer. Further, virtually the entirety of the developer in the developer supply container was discharged. In other words, the amount of the developer which remained unusable in the developer supply container was extremely small, and hardly any developer particles remained adhering to the internal surface of the developer supply container wall.

Next, the developer supply container in the first embodiment was filled with the toner B so that the ratio of the toner B in the developer supply container relative to the internal volume of the developer supply container became 0.40

[g/cc]. Then, the developer supply container was laid on its side, and was tapped 1,000 times. Then, the developer supply container was subjected to the same toner discharge performance test as the one described above. Although the developer in the developer supply container was in the compacted state, blocking the toner outlet, prior to the rotation of the developer supply container, it quickly became uncompacted as soon as the developer supply container began to be rotated. Thereafter, the toner was discharged in the preferable manner, and the developer outlet was rarely blocked by the developer, and virtually the entirety of the developer in the developer supply container was discharged. In other words, the amount of the developer which remained unusable in the developer supply container was extremely small, and virtually no developer particles remained adhering to the internal surface of the developer supply container wall.

[Test 3]

The developer supply container in the first embodiment was filled with the toner C so that the ratio of the toner C in the developer supply container relative to the internal volume of the developer supply container became 0.46 [g/cc]. Then, the developer supply container was subjected to the same toner discharge performance test as the one carried out in Test 1. Also in this test, the toner was discharged in the preferable manner from the beginning, and the developer outlet was rarely blocked by the developer. Further, virtually the entirety of the developer in the developer supply container was discharged. In other words, the amount of the developer which remained unusable in the developer supply container was extremely small, and hardly any developer particles remained adhering to the internal surface of the developer supply container wall.

Next, the developer supply container in the first embodiment was filled with the toner C so that the ratio of the toner C in the developer supply container relative to the internal volume of the developer supply container became 0.46 [g/cc]. Then, the developer supply container was laid on its side, and was tapped 1,000 times. Then, the developer supply container was subjected to the same toner discharge performance test as the one described above. Although the developer in the developer supply container was in the compacted state, blocking the toner outlet, prior to the rotation of the developer supply container, it quickly became uncompacted as soon as the developer supply container began to be rotated. Thereafter, the toner was discharged in the preferable manner, and the developer outlet was rarely blocked by the developer, and virtually the entirety of the developer in the developer supply container was discharged. In other words, the amount of the developer which remained unusable in the developer supply container was extremely small, and hardly any developer particles remained adhering to the internal surface of the developer supply container wall.

[Test 4]

The developer supply container in which the developer was stored in this test was the same as the one in the first embodiment.

(Formulation of Mixture of Carrier and Toner)

Eighty units of mass of toner A, and 20 units of mass of resinous carrier of magnetic substance dispersion type, which was 35 [$\mu$m] in average particle diameter and 3.6 in absolute specific gravity, were thoroughly mixed in advance with the use of a mixer. The tensile strength of the obtained developer was 2.5 [g/cm$^2$].

The developer supply container in the first embodiment was filled with the above developer so that the ratio of the developer in the developer supply container relative to the internal volume of the developer supply container became 0.45 [g/cc]. Then, the developer supply container was subjected to a developer (mixture of toner and carrier) discharge performance test similar to the toner discharge performance test as one carried out in Test 1. Also in this test, the developer was discharged in the desirable manner from the beginning. Further, virtually the entirety of the developer in the developer supply container was discharged. In other words, the amount of the developer which remained unusable in the developer supply container was extremely small, and hardly any developer particles remained adhering to the internal surface of the developer supply container wall.

Further, the ratio of the toner and carrier in the developer was continuously measured as the developer was discharged, confirming that hardly any segregation occurred between the carrier and toner.

Next, the developer supply container in the first embodiment was filled with the above described developer so that the ratio of the developer in the developer supply container relative to the internal volume of the developer supply container became 0.43 [g/cc], Then, the developer supply container was laid on its side, with the opening of the developer outlet facing downward, and was tapped 1,000 times. Then, the developer supply container was subjected to the developer discharge performance test similar to the one described above. Although the developer in the developer supply container was in the compacted state, blocking the toner outlet, prior to the rotation of the developer supply container, it quickly became uncompacted as soon as the developer supply container began to be rotated. Thereafter, the toner was discharged in the desirable manner, and the developer outlet was rarely blocked by the developer, and virtually the entirety of the developer in the developer supply container was discharged. In other words, the amount of the developer which remained unusable in the developer supply container was extremely small, and hardly any developer particles remained adhering to the internal surface of the developer supply container wall.

Further, the ratio of the toner and carrier in the developer was continuously measured as the developer was discharged, confirming that hardly any segregation occurred between the carrier and toner.

[Test 5]

The developer supply container structured as described in the second embodiment was filled with the toner A so that the ratio of the toner A in the developer supply container relative to the internal volume of the developer supply container became 0.40 [g/cc]. Then, the developer supply container was tested for toner discharge performance, using a simplified rotary type toner discharging jig (created by removing the developing devices from the rotary type developing devices so that the amount of the developer discharged from the developer outlet of each developer supply container can be directly measured). The incremental rotational angle of the developer amount measurement jig was set to 90°×4(90°→90°→90°→90°). The time during which the jig was kept stationary was set to roughly 0.3 second. The peripheral velocity of the jig during its movement was set to approximately 0.7 [m/s]. The toner was desirably discharged from the beginning, and virtually the entirely of the developer in the developer supply container was discharged. In other words, the amount by which the developer remained unusable in the developer supply container was very small, and there were virtually no developer particles remaining adhered to the internal surface of the developer supply container wall.

Next, the developer supply container structured as described in the second embodiment was filled with the toner A so that the ratio of the toner A in the developer supply container relative to the internal volume of the developer supply container became 0.40 [g/cc]. Then, the developer supply container was laid on its side, and was tapped 1,000 times. Then, the developer supply container was subjected to the same toner discharge performance test as the one described above. Although the developer in the developer supply container was in the compacted state, blocking the developer outlet, prior to the rotation of the developer supply container, it quickly became uncompacted as soon as the developer supply container began to be rotated. Thereafter, the toner was discharged in the desirable manner, and the developer outlet was rarely blocked by the developer. Further, virtually the entirety of the developer in the developer supply container was discharged. In other words, the amount of the developer which remained unusable in the developer supply container was extremely small, and hardly any developer particles remained adhering to the internal surface of the developer supply container wall.

[Comparative Tests]

The developer supply container used in this test to store developer was the same as the one in the first embodiment.

The developer supply container in the first embodiment was filled with the toner D so that the ratio of the toner D in the developer supply container relative to the internal volume of the developer supply container became 0.43 [g/cc]. Then, the developer supply container was subjected to the same toner discharge performance test as the one carried out in Test 1. In this comparison test, however, no less than 10% of the developer failed to be discharged, remaining unused in the developer supply container. Further, a substantial amount of the developer remained adhering to the internal surface and/or conveyance ribs of the developer supply container.

Next, the developer supply container in the first embodiment was filled with the toner F so that the ratio of the toner F in the developer supply container relative to the internal volume of the developer supply container became 0.43 [g/cc]. Then, the developer supply container was laid on its side, and was tapped 1,000 times. Then, the developer supply container was subjected to the same toner discharge performance test as the one described above. In the case of this comparative test, the compacted developer did not become uncompacted until the developer supply container was orbitally moved for no less than 5 minutes. After the developer became uncompacted, the developer was discharged, although the discharge speed was extremely slow; the developer discharge performance was at a significantly low level.

(Miscellaneous Embodiments)

In the preceding embodiments, the rotary type developing apparatus comprised three developing devices. The number of the developing devices, however, does not need to be limited to three. In other words, the number of the developing devices may be decided as necessary.

The image forming apparatuses in the preceding embodiments were copying machines. The application of the present invention, however, is not limited to a copying machine. For example, the present invention is applicable to image forming apparatuses, such as a printer, a facsimileing machine, etc., other than a copying machine. Regarding an intermediary transferring means, the present invention is also applicable to an image forming apparatus, which employs, as an intermediary transferring member, a transfer drum, instead of a transfer belt, onto which a plurality of toner images different in color are sequentially transferred in layers, and from which the plurality of the layered toner images are transferred all at once onto a transfer medium. Further, the image forming apparatus to which the present invention is applied may be such an image forming apparatus which employs a transfer medium bearing member, for example, a transfer-conveyance belt, a transfer drum, etc., so that a plurality of toner images different in color are sequentially transferred in layers onto a transfer medium on the transfer medium bearing member. The application of the present invention to such image forming apparatuses offers the same effects as those described above.

As is evident from the above descriptions of the preceding embodiments of the present invention, the present invention provides the following effects.

The present invention provides a developer supply container, which is inexpensive, highly reliable, and repeatedly usable; in which the developer (toner) particles do not remain agglomerated or compacted, and a certain portion of the body of the developer slips through the intervals of the conveyance ribs, preventing the developer conveyance speed from deteriorating; and which is capable of maintaining at a desirable level the rate at which the developer is discharged, from immediately after the developer supply container is put to use until it is depleted of the developer.

The present invention can provide a developer supply container, which is extremely small in the amount of the developer which fails to be discharged, remaining unusable, and the amount of the developer which adheres to the internal surface of the developer supply container. In other words, the present invention can provide a developer supply container capable of discharging virtually the entirety of the developer stored therein.

The present invention can provide a developer supply container, in which even after the developer in the developer supply container agglomerates and/or becomes compacted in the developer supply container due to the vibrations during the shipment of the developer supply container and/or because the developer supply container is stored unattended for a long time in an environment in which temperature and humidity are high, the developer can be easily loosened with the application of a small amount of external force, making it possible to continuously convey and discharge the developer by a predetermined rate until the depletion of the developer therein.

The present invention can provide a developer supply container, the developer outlet of which is never blocked by the developer therein, regardless of the various ambiences in which the developer supply container is used.

Incidentally, the addition of a fluidizing agent to a developer reduces the degree of the agglomerativeness and adhesiveness of the developer, enhancing the characteristics of a developer supply container in accordance with the present invention that even after the developer in the developer supply container agglomerates and/or becomes compacted in the developer supply container due to the vibrations during the shipment of the developer supply container and/or because the developer supply container is stored unattended for a long time in an environment in which temperature and humidity are high, the developer easily loosens, and the manner in which the developer is discharged remains unaffected. Further, the fluidizing agent added to the developer is hydrophobic. Therefore, the addition of the fluidizing agent eliminates the effects of the humidity even in a high temperature-high humidity ambience, preventing thereby the developer agglomeration, as well as maintaining at a desirable level the chargeability of the developer for a long time regardless of ambience.

The addition of wax at a ratio of 0.5–30 units of mass of wax to 100 units of mass of the bonding resin of toner improves the developer in terms of offset resistance and color mixture during the toner image fixation process. When a developer, containing wax at the above describe ratio, is stored in a developer supply container in accordance with the present invention, the ease with which the developer loosens, and the manner in which the developer is discharged remains unaffected, and the developer discharge performance is not affected even after the developer in the developer supply container agglomerates and/or becomes compacted in the developer supply container due to the vibrations during the shipment of the developer supply container and/or because the developer supply container is stored unattended for a long time in an environment in which temperature and humidity are high.

Formulating toner so that no less than 80% of the toner particles thereof, in terms of the number based cumulative value, is greater than 0.900 in circularity degree a (a=L0/L, wherein L1 stands for circumference of circle equal in size to projected image of toner particle, and L stands for circumference of projected image of toner particle) further reduces the agglomerativeness and adhesiveness of the developer. Thus, when a developer formulated as described above is stored in a developer supply container in accordance with the present invention, the ease with which the developer loosens, and the developer discharge performance, are not affected even after the developer in the developer supply container agglomerates and/or becomes compacted in the developer supply container due to the vibrations during the shipment of the developer supply container and/or because the developer supply container is stored unattended for a long time in an environment in which temperature and humidity are high.

In the case of a developer which is a mixture of toner and carrier, formulating it so that the ratio of the carrier becomes no more than 40 wt. % (5–40 wt. %) to the entirety of the developer makes it unlikely for the toner to segregate from the carrier in a developer supply container.

The partial overlapping of the end portions of the adjacent two developer conveyance ribs, in terms of the direction perpendicular to the rotational axis of the rotary type developing apparatus, prevents the decline of the developer conveyance performance which might otherwise occur due to the escaping of the developer through the gaps between the adjacent two conveyance ribs.

The provision of the detour causing rib which conveys the developer in such a manner that the developer is once conveyed to the immediate adjacencies, in terms of the rotational axis of the rotary type developing apparatus, of the developer outlet, and then, is conveyed away from the developer outlet, prevents the developer outlet from being blocked by the developer. Further, as the developer is moved away from the developer outlet by the rotation of the rotary type developing apparatus, it is further stirred by the conveyance ribs, thereby always remaining fluid. Therefore, the developer is smoothly discharged through the developer outlet. Further, as it is supplied into the developing device, it is likely to be easily mix with the developer in the developing device. Therefore, even if the developer is a two-component developer, it is instantly and uniformly charged.

The angle at which the conveyance ribs are tilted is kept in a range of 20°–70°. Therefore, a desired amount of developer conveyance force is obtained.

The developer supply container is mounted in the rotary of a rotary type developing apparatus, in such a manner that it does not rotate about its axial line, and that it is orbitally moved about the rotational axis of the rotary type developing apparatus. Therefore, it is unnecessary to provide the developer supply container with a structure for receiving the force for rotating the developer supply container, contributing to the cost reduction for the developer supply container as well as the apparatus main assembly.

The main assembly of a developer supply container is shaped so that its cross section becomes noncircular. Therefore, the limited internal space of the rotary of a rotary type developing apparatus is efficiently used, while increasing the developer capacity of the developer supply container.

The main assembly of a developer supply container is constructed by joining members molded with the use of an injection molding method. Therefore, the manufacturing cost is lower. Further, the choices of the developer supply container material are not limited, making it possible to choose a flame resistant resin as the developer supply container material, and therefore, making it easier to deal with safety and environmental concerns.

While the invention has been described with reference to the structures disclosed herein, it is not confined to the details set forth, and this application is intended to cover such modifications or changes as may come within the purposes of the improvements or the scope of the following claims.

What is claimed is:

1. A developer supplying kit for being detachably set in an image forming apparatus to supply toner thereto, said developer supplying kit comprising:

a developer container for containing developer;

a discharge opening, provided in said developer container, for discharging the developer; and a plurality of feeding projections for feeding the developer in said toner container toward said discharge opening with rotation of said developer container, said feeding projections being provided on an inside surface of said developer container independently from each other and having a non-twisted and straight configuration, wherein a uniaxial collapse stress of a layer of the developer powder, which has been compressed with a vertical stress of 128 g/cm$^2$, is 2.0–8.0 g/cm$^2$.

2. A developer supplying kit according to claim 1, wherein a tensile strength of the layer is 1.0–5.0 g/cm$^2$.

3. A developer supplying kit according to claim 1, wherein said feeding projections are at least partly overlapped as seen in a direction perpendicular to a direction of rotation of said developer container.

4. A developer supplying kit according to claim 1, wherein said toner container comprises first and second injection-molded members with said feeding projections.

5. A developer supplying kit according to claim 4, wherein said first member includes said discharge opening, and only said first member includes a diameter-reduced portion provided at said discharge opening.

6. A developer supplying kit according to claim 1, wherein said feeding projections are inclined such that angles formed between said feeding projections and a direction perpendicular to a rotational direction of said toner container are 20–30 degrees.

7. A developer supplying kit according to claim 1, further comprising a by-pass feeding portion, which is projected from an inner side of said toner container, said by-pass feeding portion, being effective to permit the developer fed by said feeding projections to feed temporarily toward said discharge opening, which is formed in a peripheral surface of said developer container and to by-pass said discharge opening toward a downstream direction with respect to the direction of feeding of said projections.

8. A developer supplying kit according to claim 7, further comprising a returning member for returning developer by-passed by said by-pass feeding portion toward said discharge opening.

9. A developer supplying kit according to claim 1, wherein each of said feeding projections includes a first guiding part for guiding the developer in a first direction with rotation of said developer container and a second guiding part for guiding the developer in a second direction, which is different from the first direction.

10. A developer supplying kit according to claim 1, wherein said developer container is set on a rotary member provided in the image forming apparatus substantially against rotation relative to said rotary member, and the developer is fed by rotation of the rotary member.

* * * * *

UNITED STATES PATENT AND TRADEMARK OFFICE

CERTIFICATE OF CORRECTION

PATENT NO. : 6,987,942 B2
APPLICATION NO. : 10/419758
DATED : January 17, 2006
INVENTOR(S) : Junko Yoshikawa et al.

It is certified that error appears in the above-identified patent and that said Letters Patent is hereby corrected as shown below:

COLUMN 1:

Line 8, “facsimileing” should read --facsimile--; and
Line 55, “2,000-284588” should read --2000-284588--.

COLUMN 2:

Line 19, “2,000-214669” should read --2000-214669--;
Line 54, “comprises:” should read --comprise:--; and
Line 57, “veyed” should read --vey--.

COLUMN 3:

Line 6, “2,000-214669” and “2,000-284588,” should read --2000-214669-- and --2000-284588,--.

COLUMN 5:

Line 25, “2,000-352840,” should read --2000-352840,--;
Line 29, “2,000-137351” should read --2000-137351--; and
Line 44, “stated.” should read --state.--.

COLUMN 7:

Line 8, “developin” should read --developing--.

COLUMN 11:

Line 33, “the form” should read --from the--.

COLUMN 12:

Line 16, “a” should read --an--.

COLUMN 14:

Line 39, “referential-numeral 1” should read --referential numeral 1--.

UNITED STATES PATENT AND TRADEMARK OFFICE

CERTIFICATE OF CORRECTION

PATENT NO. : 6,987,942 B2
APPLICATION NO. : 10/419758
DATED : January 17, 2006
INVENTOR(S) : Junko Yoshikawa et al.

It is certified that error appears in the above-identified patent and that said Letters Patent is hereby corrected as shown below:

COLUMN 16:

Line 31, “is” should read --are--; and “its” should read --their--;
Line 32, “its” should be deleted; and
Line 36, “seen the” should read --seen--.

COLUMN 17:

Line 30, “rotates” should read --rotate--.

COLUMN 18:

Line 20, “assembles” should read --assemblies--;
Line 36, “(Φ36)” should read --(ϕ36)--;
Line 38, “(Φ31),” should read --(ϕ31),--;
Line 39, “(Φ25).” should read --(ϕ25).--;
Line 43, “(Φ36)” should read --(ϕ36)--;
Line 45, “(Φ31),” should read --(ϕ31),--;
Line 46, “(Φ25),” should read --(ϕ25),--; and
Line 63, “diameter ø” should read --diameter ϕ--.

COLUMN 19:

Line 40, “develop” should read --developer--.

COLUMN 21:

Line 29, “30 mm,” should read --30 mm.--.

COLUMN 23:

Line 3, “develop” should read --developer--; and
Line 17, “interferring” should read --interfering with--.

UNITED STATES PATENT AND TRADEMARK OFFICE

CERTIFICATE OF CORRECTION

PATENT NO. : 6,987,942 B2
APPLICATION NO. : 10/419758
DATED : January 17, 2006
INVENTOR(S) : Junko Yoshikawa et al.

It is certified that error appears in the above-identified patent and that said Letters Patent is hereby corrected as shown below:

COLUMN 24:

Line 19, “were” should read --was--;
Line 46, “ι” should read --τ--;
Line 51, “ι” should read --τ--;
Line 54, “ιi (ι1” should read --τi (τ1--; and
Line 55, “ι2).” should read --τ2).--; and “ι” should read --τ--.

COLUMN 28:

Line 54, “circumferential” should read --circumference--.

COLUMN 29:

Line 66, “Apparatus,” should read --apparatus,--.

COLUMN 31:

Line 18, “embodiment;” should read --embodiment,--.

COLUMN 33:

Line 14, “Hybrid resin comprising polyester units and vinyl” should be deleted;
In Table 17, “polymer unit:” should read --Hybrid resin comprising polyester units and vinyl polymer unit:--; and
Line 49, “mixture -was” should read --mixture was--.

COLUMN 36:

Line 22, “[g/cc],” should read --[g/cc].--; and
Line 61, “entirely” should read --entirety--.

COLUMN 37:

Line 62, “facsimileing” should read --facsimile--.

UNITED STATES PATENT AND TRADEMARK OFFICE

CERTIFICATE OF CORRECTION

PATENT NO. : 6,987,942 B2
APPLICATION NO. : 10/419758
DATED : January 17, 2006
INVENTOR(S) : Junko Yoshikawa et al.

It is certified that error appears in the above-identified patent and that said Letters Patent is hereby corrected as shown below:

COLUMN 39:

Line 5, “describe” should read --described--; and
Line 59, “mix” should read --mixed--.

COLUMN 40:

Line 51, “toner” should read --developer--;
Line 61, “20-30 degrees.” should read --20-70 degress.--;
Line 64, “toner” should read --developer--; and
Line 65, “portion,” should read --portion--.

COLUMN 41:

Line 3, “said” should read --said feeding--.

COLUMN 42:

Line 7, “said” should read --the--.

Signed and Sealed this

Eighth Day of August, 2006

JON W. DUDAS
*Director of the United States Patent and Trademark Office*